US008612072B2

(12) United States Patent
Garon et al.

(10) Patent No.: US 8,612,072 B2
(45) Date of Patent: Dec. 17, 2013

(54) SYSTEM FOR AUTOMATICALLY INSTANCING MARINE ENGINES

(75) Inventors: Pierre Garon, Quebec (CA); Neil Garfield Allyn, British Columbia (CA); James Steven Monczynski, Palmetto, FL (US); Thomas Samuel Martin, British Columbia (CA)

(73) Assignee: Teleflex Canada, Inc., Richmond, British Columbia (CA)

( * ) Notice: Subject to any disclaimer, the term of this patent is extended or adjusted under 35 U.S.C. 154(b) by 606 days.

(21) Appl. No.: 12/704,379

(22) Filed: Feb. 11, 2010

(65) Prior Publication Data

US 2011/0196553 A1 Aug. 11, 2011

(51) Int. Cl.
*B63H 21/00* (2006.01)

(52) U.S. Cl.
USPC ..... 701/21; 440/4; 440/84; 340/3.5; 340/9.1

(58) Field of Classification Search
USPC ..... 701/1, 21; 726/1–3; 710/8–9, 26; 709/223–226, 245; 370/254, 257; 440/84, 1–4, 86–87, 113; 340/3.1, 3.5, 340/3.52, 3.53, 3.54, 9.1, 9.11, 9.13, 9.15, 340/9.16

See application file for complete search history.

(56) References Cited

U.S. PATENT DOCUMENTS 5,241,250 A * 8/1993 Nagasawa et al. ..... 318/591
5,349,644 A * 9/1994 Massey et al. ..... 706/10
5,551,053 A * 8/1996 Nadolski et al. ..... 710/9
6,216,083 B1 * 4/2001 Ulyanov et al. ..... 701/106
6,273,771 B1 * 8/2001 Buckley et al. ..... 440/84
6,801,507 B1 * 10/2004 Humpleman et al. ..... 370/257
6,859,692 B2 * 2/2005 Okuyama ..... 701/21
7,144,283 B2 * 12/2006 Kawase ..... 440/84
7,184,867 B2 * 2/2007 Okuyama ..... 701/36
7,330,782 B2 2/2008 Graham et al.
7,408,950 B2 * 8/2008 Okuyama ..... 370/447
7,430,461 B1 * 9/2008 Michaels ..... 701/21
7,442,101 B2 * 10/2008 Kawase et al. ..... 440/1
7,444,213 B2 * 10/2008 Motose ..... 701/21
7,559,812 B2 * 7/2009 Yamada et al. ..... 440/2
7,938,701 B2 * 5/2011 Ito et al. ..... 440/1
8,162,703 B2 * 4/2012 Bamba ..... 440/1
8,229,608 B2 * 7/2012 Yamamura et al. ..... 701/21
8,406,944 B2 * 3/2013 Garon et al. ..... 701/21
2002/0077721 A1 * 6/2002 Linn et al. ..... 700/193

(Continued)

FOREIGN PATENT DOCUMENTS

WO 2009/026663 A1 3/2009

*Primary Examiner* — Thomas Black
*Assistant Examiner* — Ce Li
(74) *Attorney, Agent, or Firm* — Berenato & White, LLC

(57) ABSTRACT

The system herein disclosed automatically detects whether an engine control unit instance number of a multi-engine marine vessel needs changing. Each engine control unit is electronically paired with a respective servo controller. A vessel controller is in communication with the servo controllers. The vessel controller commands in turn each servo controller to switch on its paired engine control unit, read the instance number of its paired engine control unit, switch off its paired engine control unit, and convey the instance number back to the vessel controller. The vessel controller then compares the instance numbers of the engine control units. If at least two instance numbers of the engine control units are duplicates of each other, the vessel controller ascertains that at least one of the instance numbers of the engine control units needs to be changed and assigns a new instance number to one of the engine control units.

24 Claims, 15 Drawing Sheets

(56) References Cited

U.S. PATENT DOCUMENTS

| | | | | |
|---|---|---|---|---|
| 2003/0082962 | A1* | 5/2003 | Kanno | 440/2 |
| 2003/0093196 | A1* | 5/2003 | Okuyama | 701/21 |
| 2004/0057450 | A1* | 3/2004 | Okuyama | 370/447 |
| 2004/0059478 | A1* | 3/2004 | Okuyama | 701/21 |
| 2005/0118896 | A1* | 6/2005 | Okuyama et al. | 440/2 |
| 2005/0288833 | A1* | 12/2005 | Motose | 701/21 |
| 2006/0009878 | A1* | 1/2006 | Kobayashi et al. | 700/245 |
| 2006/0089059 | A1* | 4/2006 | Kawase | 440/1 |
| 2006/0089060 | A1* | 4/2006 | Kawase et al. | 440/1 |
| 2006/0293807 | A1* | 12/2006 | Okuyama | 701/21 |
| 2007/0082566 | A1* | 4/2007 | Okuyama | 440/53 |
| 2007/0232162 | A1* | 10/2007 | Okuyama et al. | 440/84 |
| 2007/0293102 | A1* | 12/2007 | Okuyama et al. | 440/1 |
| 2008/0020656 | A1* | 1/2008 | Yamada et al. | 440/1 |
| 2008/0026649 | A1* | 1/2008 | Ito et al. | 440/1 |
| 2008/0214069 | A1* | 9/2008 | Kawanishi et al. | 440/84 |
| 2009/0261771 | A1* | 10/2009 | Pearce et al. | 318/573 |
| 2010/0048068 | A1* | 2/2010 | Bamba | 440/1 |
| 2010/0185325 | A1* | 7/2010 | Kwon | 700/245 |
| 2011/0136696 | A1* | 6/2011 | Heiner et al. | 506/23 |

* cited by examiner

SYSTEM FOR AUTOMATICALLY INSTANCING MARINE ENGINES

FIELD OF THE INVENTION

The present invention relates to a system for automatically detecting whether at least one of the addresses or instance numbers of a plurality of engine control units of a marine vessel needs to be changed. The system is capable of assigning new instance numbers to engine control units.

DESCRIPTION OF THE RELATED ART

Marine engines such as outboard engines are typically provided with engine control units, in this example, engine management modules having a default instance number of, for example, 0. This does not present a problem when the marine vessel only has one outboard engine. However it does present a problem when there are more outboard engines, such as two engines. In these cases a vessel controller of the marine vessel will initially read two engine management modules both having instance numbers of 0. The vessel controller will therefore be inhibited from distinguishing between the two outboard engines.

To deal with this issue of duplicate instance numbers, an external computer is typically used to reset one of the instance numbers. This will typically also require a technician skilled in this specific area of marine technology and skilled in the computer program interfacing involved.

The above-described prior art may suffer a number of disadvantages. For example, external computers may not always be readily available. This is particularly true, for example, in remote locations. Also, using external computers on marine vessels increases the chances of such external computers becoming damaged and/or destroyed by, for example, water spray. External computers may be readily on hand but the required software may not be readily available. Partially impaired or non-functioning computers lead to delays.

A technician skilled in resetting instance numbers for outboard engines oftentimes may not be readily available. Even if such a technician is available, labour costs in resetting instance numbers may increase costs to the user.

BRIEF SUMMARY OF INVENTION

It is an object of the present invention to provide, and the present invention does provide, a system disclosed herein for automatically detecting when at least one instance number from a plurality of engine control units of a marine vessel needs to be changed and automatically assigning at least one new, non-duplicate instance number as required.

There is accordingly provided a system for automatically detecting whether at least one of the addresses of a plurality of engine control units of a marine vessel needs to be changed. The system includes a plurality of servo controllers and the plurality of engine control units. Each of the engine control units and has an address and is electronically paired with respective ones of the servo controllers. The system includes a vessel controller in communication with the servo controllers and the engine controllers. The vessel controller commands all servo controllers to switch off their paired engine control unit. The vessel controller then commands in turn each of the servo controllers to switch on its paired one of the engine control units, read the address of its paired one of the engine control units, switch off its paired one of the engine control units, and convey the address back to the vessel controller. The vessel controller then compares the addresses of the engine control units as well as the addresses of the servo controllers. If at least two the addresses of the engine control units or of the servo controllers are duplicates of each other or out of the expected range of addresses, the vessel controller ascertains that at least one of the addresses of the engine control units or of the servo controllers needs to be changed.

There is also provided the above system in combination with a marine vessel. The system includes a plurality of engines paired with respective ones of the engine control units. If at least two engine control units have duplicate addresses, the vessel controller assigns a new address to one of the at least two engine control units having duplicate addresses.

There is further provided a system for operatively assigning identities to a plurality of engines of a marine vessel. The system has a plurality of servo controllers. The system includes a plurality of engine control units each associated with a respective one of the engines and being electronically paired with a respective one of the servo controllers. The system includes a vessel controller in communication with the servo controllers. The vessel controller commands the servo controllers to switch off the engine control units. The vessel controller commands in turn each of the servo controllers to switch on its paired one of the engine control units, assign a set address to its paired one of the engine control units and switch off its paired one of the engine control units. Each set address corresponds to a unique identity. The engines are thus associated with set addresses identifiable to the vessel controller.

According to another aspect, there is provided, in combination, a servo controller for a marine engine and an instance plug. The servo controller has a socket. The instance plug is connectable with the servo controller via the socket. The instance plug contains an address for electronically identifying the servo controller to which it is connected.

There is even further provided a method of automatically detecting whether an instance number associated with one of a first engine control unit and a second engine control unit of a marine vessel needs to be changed. The method uses a vessel controller operatively connected to the first engine control unit and the second engine control unit. The method includes the step of the vessel controller causing both the first engine control unit and the second engine control unit to be switched off. The vessel controller next causes one of the first engine control unit and the second engine control unit to be switched on. The vessel controller causes the instance number of said one of the first engine control unit and the second engine control unit to be read. The vessel controller causes said one of the first engine control unit and the second engine control unit to be switched off. The vessel controller causes the instance number so read to be conveyed to the vessel controller. The method includes the step of the vessel controller causing an other of the first engine control unit and the second engine control unit to be switched on. The vessel controller causes the instance number of said other of the first engine control unit and the second engine control unit to be read. The vessel controller causes said other of the first engine control unit and the second engine control unit to be switched off. The vessel controller causes the instance number of said other of the first engine control unit and the second engine control unit to be conveyed to the vessel controller. The method includes the step of the vessel controller comparing the instance number of the first engine control unit with the instance number of the second engine control unit. If the instance number of the first engine control unit and the instance number of the second engine control unit are duplicates of each other, the vessel controller ascertains that one of the instance number of the first engine control unit and the instance number of the second engine control unit needs to be changed.

There is yet further provided a method of automatically detecting whether at least one instance number associated with at least one of a plurality of engine control units of a marine vessel needs to be changed. The engine control units each have an instance number and are paired with servo controllers. The method uses a vessel controller electronically coupled to the servo controllers in a manner predetermined by the vessel controller. The method includes the step of the vessel controller commanding the servo controllers to switch off the engine control units. The vessel controller commands in turn each of the servo controllers to switch on its paired one of the engine control units, read the instance number of its paired one of the engine control units, switch off its paired one of the engine control units, and convey the instance number back to the vessel controller. The method includes the step of the vessel controller comparing the instance numbers of the engine control units, whereby if at least two said instance numbers of the engine control units are duplicates of each other, the vessel controller ascertains that at least one of the instance numbers of the engine control units needs to be renumbered.

There is further provided a method of assigning identities to a plurality of engine control units of a marine vessel. The engine control units each have an address and each is paired with a respective one of a first servo controller or a second servo controller. The method uses a vessel controller electronically coupled to the first servo controller and the second servo controller, respectively, in a manner predetermined by the vessel controller. The method includes the step of the vessel controller instructing the first servo controller to switch off its peer engine control unit and the second control unit to switch off its peer engine control unit. The method includes the step of the vessel controller instructing the first servo controller to switch on its peer engine control unit, assign an address to its peer engine control unit and then switch off its peer engine control unit. The method includes the step of the vessel controller instructing the second servo controller to switch on its peer engine control unit, assign a further address to its peer engine control unit and then switch off its peer engine control unit.

There is also provided a method of automatically instancing a plurality of engine control units of a marine vessel. The engine control units each have an instance number. The engine control units are paired with servo controllers. A vessel controller is electronically coupled with the servo controllers in a manner predetermined by the vessel controller. The method includes the step of the vessel controller commanding each of the servo controllers to switch off its paired engine control unit. The method includes the step of the vessel controller commanding in turn each of the servo controllers to switch on its paired one of the engine control units, read the instance number of its paired one of the engine control units, switch off its paired one of the engine control units, and convey the instance number back to the vessel controller. The method includes the step of the vessel controller comparing the instance numbers of the engine control units to determine if at least two said instance numbers are duplicates of each other. If at least two said instance numbers are duplicates of each other, the method includes the step of the vessel controller commanding a servo controller associated with one of the engine control units having a duplicate instance number to assign at least one new instance number to its peered engine control unit.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
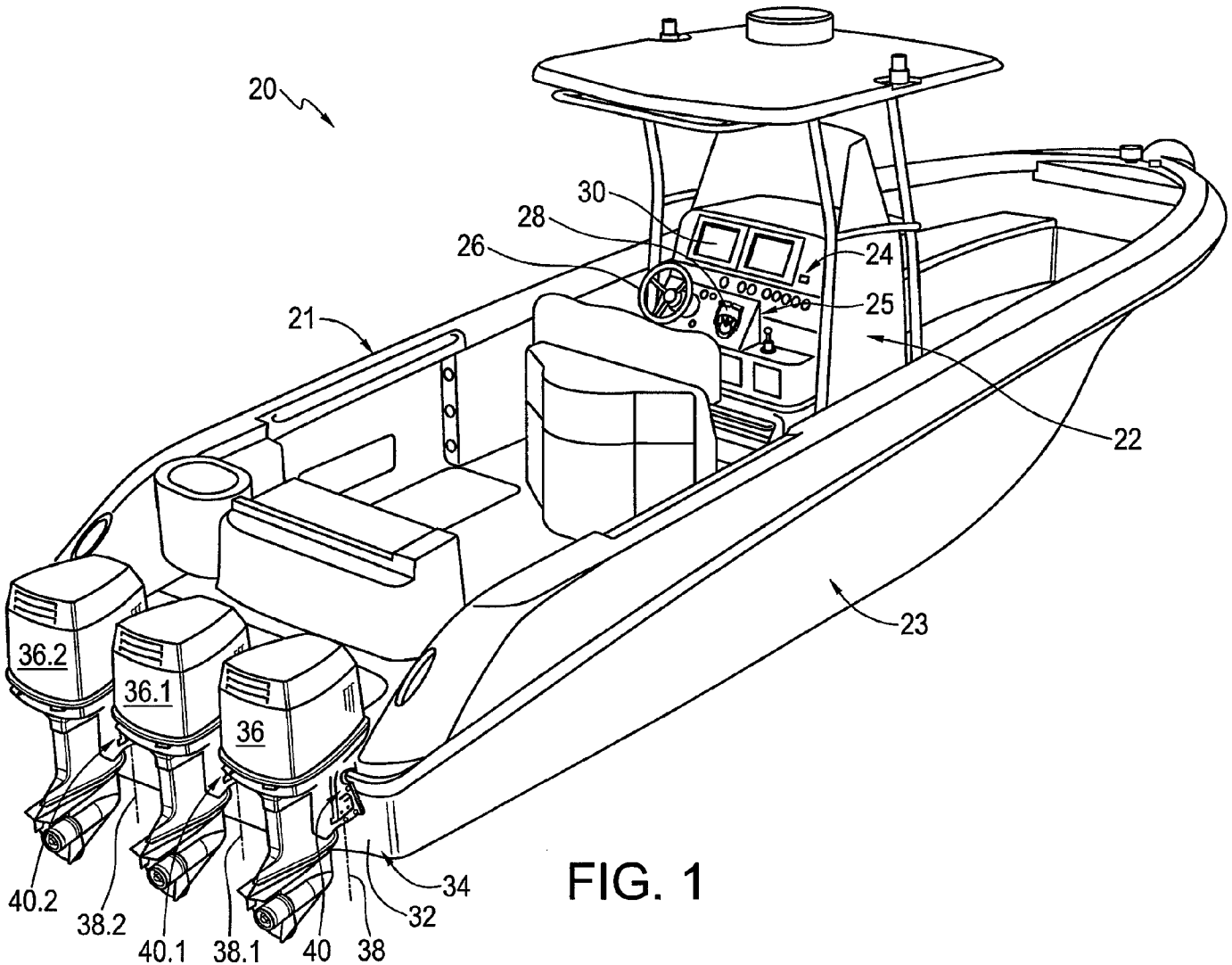
FIG. 1 is a perspective view of a marine vessel having a steering apparatus and propulsion units mounted thereon.

Referring to the drawings and first to FIG. 1, there is shown a marine vessel 20 having a control system 22 for operatively controlling and steering the vessel. The control system 22 includes a user interface 24 that provides for warnings and a means for adjusting of the system. A buzzer and a warning lamp are employed in the system in this example and a textual or graphic interface 30 can also be used. The control system 22 includes a helm 26 for steering the marine vessel 20.

The marine vessel 20 has propulsion units, in this example, comprising three engines, in this case, outboard engines 36, 36.1, and 36.2. FIGS. 2, 6, 8 to 10, and 12 to 15 include an additional two engines as described below. Engine 36.2 is positioned adjacent to a port side 21 of the vessel 20. Engine 36 is positioned adjacent to a starboard side 23 of the vessel 20. Engine 36.1 is disposed in a center position in this example midway between the port side 21 and the starboard side 23. While three engines are shown in FIG. 1, those skilled in the art will appreciate that the present invention may equally be directed to two or more engines, including but not limited to five engines in one preferred embodiment shown in FIGS. 2 to 15. The outboard engines 36, 36.1 and 36.2 are mounted to steering apparatuses 40, 40.1 and 40.2, respectively, which in turn are mounted to the stern 34 of the vessel 20, in this case via transom 32 of the vessel 20. The outboard engines 36, 36.1 and 36.2 can rotate about steering axes 38, 38.1 and 38.2, respectively. The outboard engines and steering apparatuses are substantially the same in construction and function, and are known per se to those skilled in the art. The outboard engines and steering apparatuses will therefore not be discussed in further detail.

The marine vessel 20 has an electronic shift and throttle system 25. Electronic shift and throttle systems per se are known, as for example disclosed in U.S. Pat. No. 7,330,782 to Graham et al., the disclosure in which is incorporated herein by reference.

Figure 3:
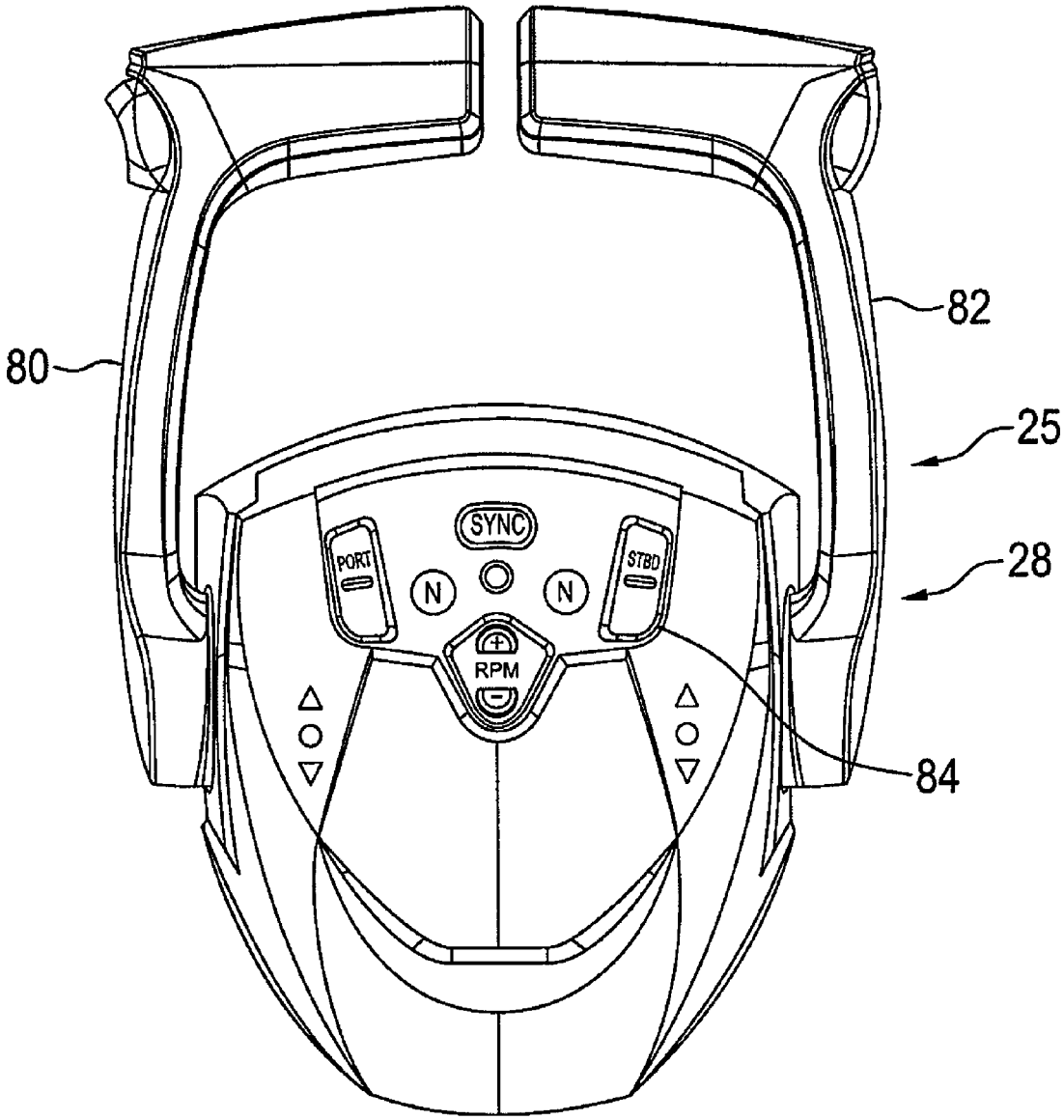
FIG. 3 is a front elevation view of a control head for the system shown in FIG. 2.

The system 25 includes a shift and throttle controller, shown in FIG. 1 by way of a control head 28. Referring to FIG. 3, the control head 28 is shown in greater detail, according to one example. While only one control head is shown, those skilled in the art will appreciate that two or more control head stations may be used in other embodiments. The control head 28 has levers 80 and 82 for adjusting the shift actuators and the throttle actuators of the engines. Lever 80 adjusts the one or more engines positioned adjacent to the port side 21 of the marine vessel. Lever 82 adjusts the one or more engines positioned adjacent to the starboard side 23 of the marine vessel. The center engine, if any, is under the control of one of the levers 80 and 82, and in this example lever 80. The control head 28 also has push buttons 84 for carrying out various tasks and functions. Control heads per se are known to those skilled in the art and therefore will not be described further.

Figure 2:
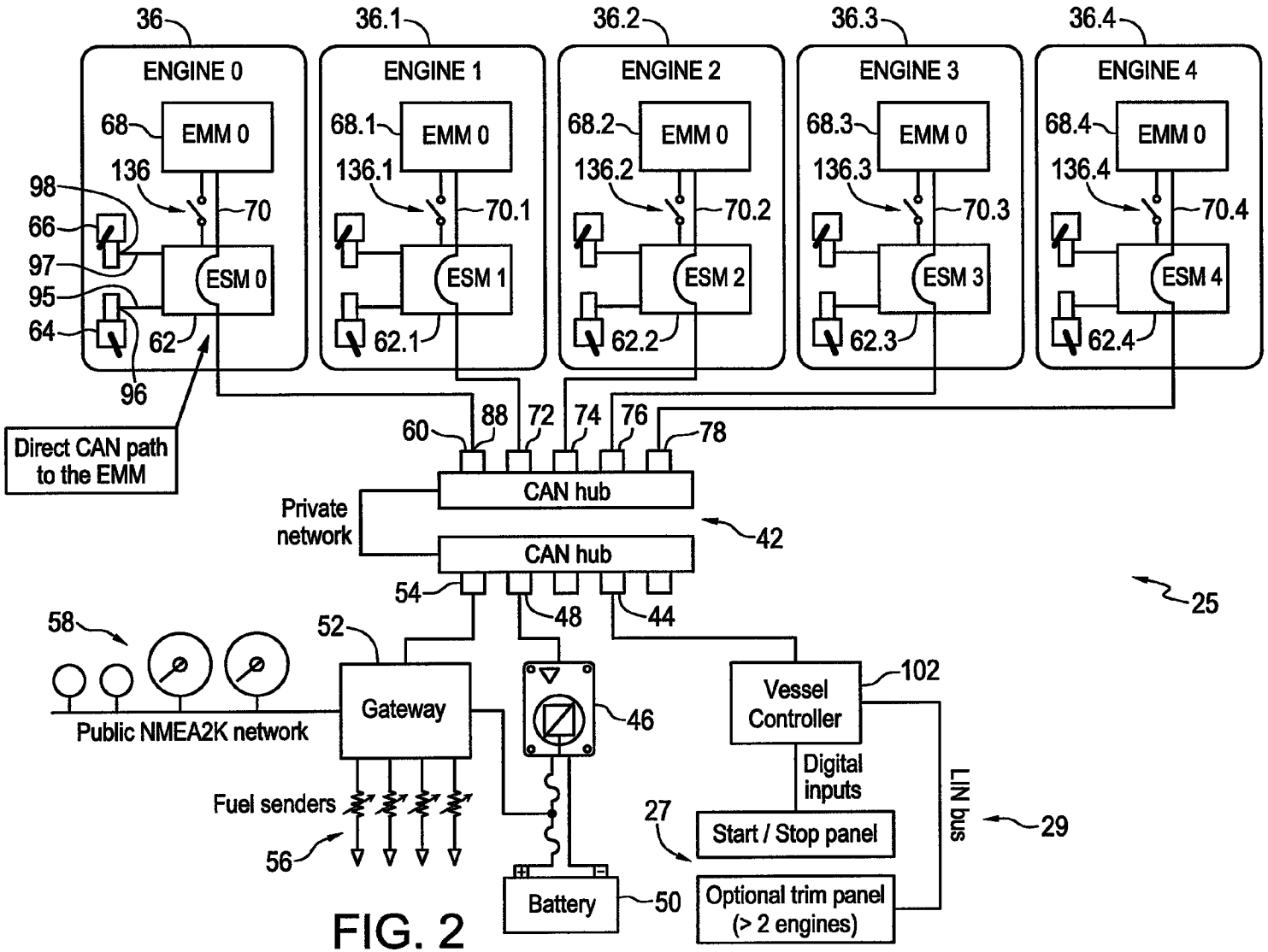
FIG. 2 is a schematic view of an electronic shift and throttle system that includes a plurality of engine assemblies similar to those of the marine vessel of FIG. 1.

The electronic shift and throttle system 25 is shown schematically in greater detail in FIG. 2. The system 25 includes a vessel controller 102. In this example the vessel controller 102 is located within, and as part of, the control head 28 shown in FIG. 3, though this is not required. Referring back to FIG. 2, various panels including trim panels 27 may be operatively connected to the vessel controller 102 via, for example, a LIN-Bus 29.

The system 25 includes a communications link in this example a standard network connection, namely a CANBus 42. These are well-known in the art. The vessel controller 102 is operatively connected to the CANBus 42 via input/output pin 44. While the CANBus network 42 is shown, one skilled in the art will appreciate that dual redundant communication architecture can be used in the system described herein.

The system 25 includes a master ignition switch 46 connected to the CANBus 42 via pin 48. The system 25 includes a power supply, in this example battery 50 operatively connected to the ignition switch 46. Battery 50 supplies CAN power to the entire private CANBus network 42. The system 25 in this example has a gateway 52 connected to the CANBus 42 via pin 54. The private CANBus network 42 of the system 25 interfaces with a public network, in this example a public NMEA2K network 58, via the gateway 52. NMEA2K is a standard for serial data neworking of marine electronic devices on CAN. Information from the system 25 is made available to the public NMEA2K network 58 via the gateway 52. The gateway 52 isolates the system 25 from public messages, but transfers engine data to displays and gauges. The gateway 52 has four analog inputs 56 which can be used to read fuel sender information and broadcast this information on the public network 58. Ignition switch systems, gateways, fuel senders, and interfacing networks per se are known and therefore will not be discussed further.

The system 25 in this example includes five outboard engines 36, 36.1, 36.2, 36.3, and 36.4. Each of the engines has substantially the same components and functions in substantially the same way. Like parts have like numbers, with the addition of ".1" for engine 36.1, ".2" for engine 36.2 and so on.

Figure 6:
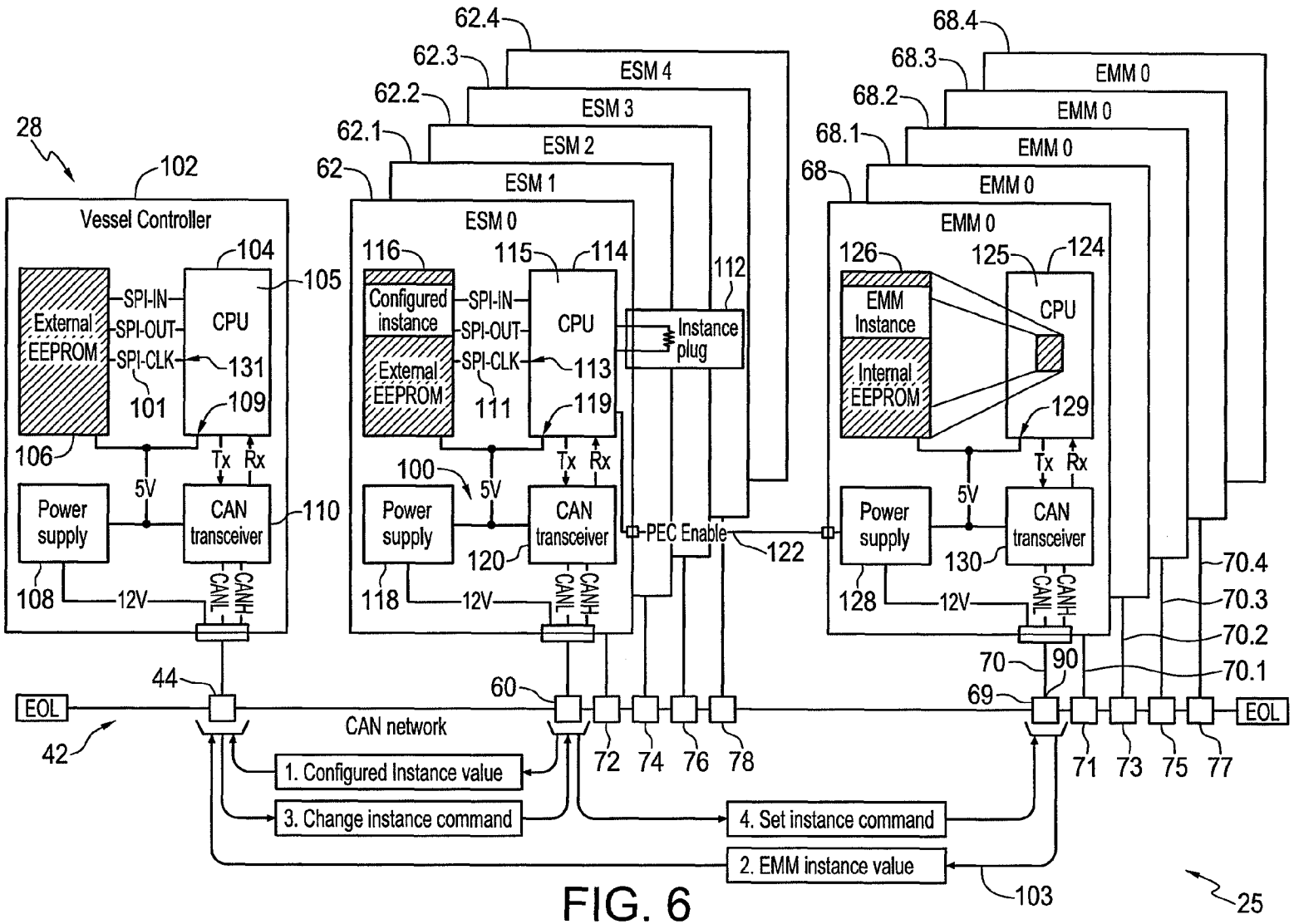
FIG. 6 is a schematic diagram of the system shown in FIG. 2 including a vessel controller, a plurality of electronic servo modules, and a plurality of engine management modules.

Engine 36 is labelled ENGINE 0 in FIG. 2. Engine 36 includes an engine control unit in this example an engine management module (EMM) 68. The acronym EMM is shown in FIGS. 2 and 6 to 15. Referring to FIG. 6, the engine management module 68 is coupled to the CANBus 42 via conductor 70 and input/output pin 69. Engine management module 68.1 is coupled to the CANBus 42 via input/output pin 71. Engine management module 68.2 is coupled to the CANBus 42 via input/output pin 73. Engine management module 68.3 is coupled to the CANBus 42 via input/output pin 75. Engine management module 68.4 is coupled to the CANBus 42 via input/output pin 77.

Engine 36 has a servo controller, in this example an electronic servo module (ESM) 62. The acronym ESM is shown in FIGS. 2 and 6 to 15. Referring to FIG. 2, engine 36 includes a throttle actuator 66 operatively coupled to the electronic servo module 62 via conductor 97. Engine 36 also includes a shift actuator 64 operatively coupled to the electronic servo module 62 via conductor 95. Throttle actuators and shift actuators per se are known to those skilled in the art and therefore will not be discussed further.

Electronic servo module 62 is operatively connected to the engine management module 68. As shown in FIG. 6, electronic servo module 62 in this example is connected to the engine management module 68 via conductor 122 of a printed electric circuit board. In like manner the rest of the electronic servo modules are operatively connected to respective engine management modules. Each electronic servo module may thus be said to have a peer or paired engine management module with which it is associated.

Referring back to FIG. 2, the electronic servo module 62 is coupled to the CANBus 42 via input/output pin 60. Electronic servo module 62.1 is coupled to the CANBus 42 via input/output pin 72, electronic servo module 62.2 is coupled to the CANBus 42 via input/output pin 74, electronic servo module 62.3 is coupled to the CANBus 42 via input/output pin 76, and electronic servo module 62.4 is coupled to the CANBus 42 via input/output pin 78.

The vessel controller 25, the electronic servo modules, and the engine management modules are thus communicatively coupled to one another via the CANBus 42. The vessel controller 25, the electronic servo modules, and the engine management modules can pass messages to one another via the CANBus 42 using a predefined protocol, such as the well-known NMEA 2000 protocol. Though CANBus 42 and NMEA 2000 are provided by way of example, it should be understood that the communications link can be any suitable communications link and can employ any suitable communications protocol.

Figure 4:
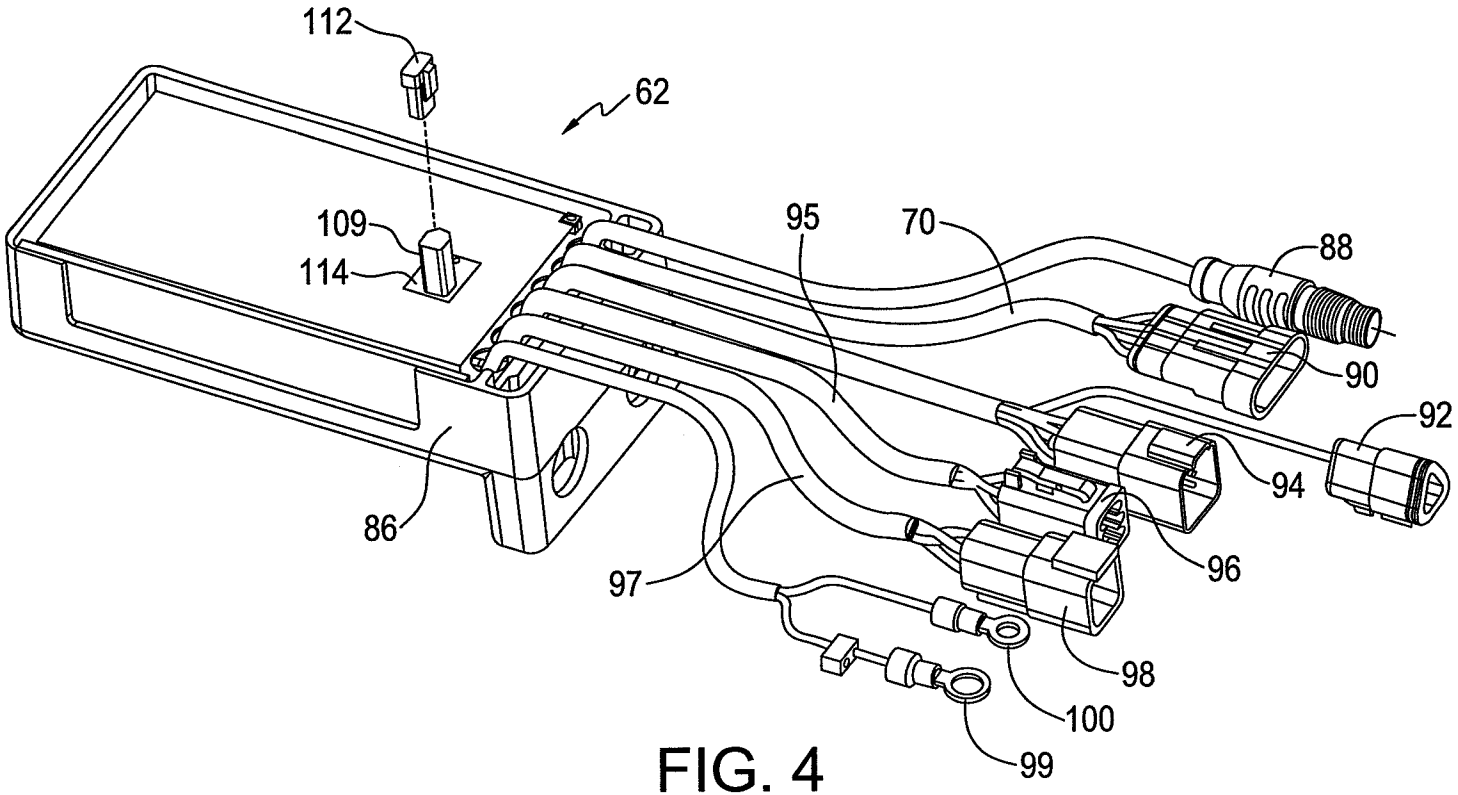
FIG. 4 is a perspective view of an electronic servo module for the system shown in FIG. 2.

Referring to FIG. 4, this shows an example of the electronic servo module 62 in physical form, with its power supply not shown. The electronic servo module 62 includes a housing 86. The electronic servo module 62 includes a processor 114, which is preferably an embedded microcontroller. The processor 114 in this example is an Infineon XC164CS type CPU, though other processors may be used. The processor 114 can receive instructions from the vessel controller 102, shown in FIG. 2, to convey and thereby assign a new address or instance number to the engine management module 68, also shown in FIG. 2. The processor 114 may therefore be referred to as part of an assigning means of the electronic servo module 102.

A data holder in this example an instance plug 112, containing an address for electronically identifying the electronic servo module, is operatively connectable to the electronic servo module 62. In this example the address of the instance plug 112 is an instance number. The instance plug 112 is received by socket 109 of the electronic servo module 62.

The electronic servo module 62 has a plurality of connectors. Connector 88 connects the electronic servo module 62 to the CANBus 42. Connector 90 enables the engine management module 68 to connect to the CANBus 42. Connectors 92 and 94 are related to trim functions of the engine, the systems for which are known and will not be discussed further. Connector 96 connects the electronic servo module 62 to the shift actuator 64 shown in FIG. 2. Connector 98 connects the electronic servo module 62 to the throttle actuator 66 of FIG. 2. Connectors 99 and 100 connect the electronic servo module 62 to its power supply.

Figure 5:
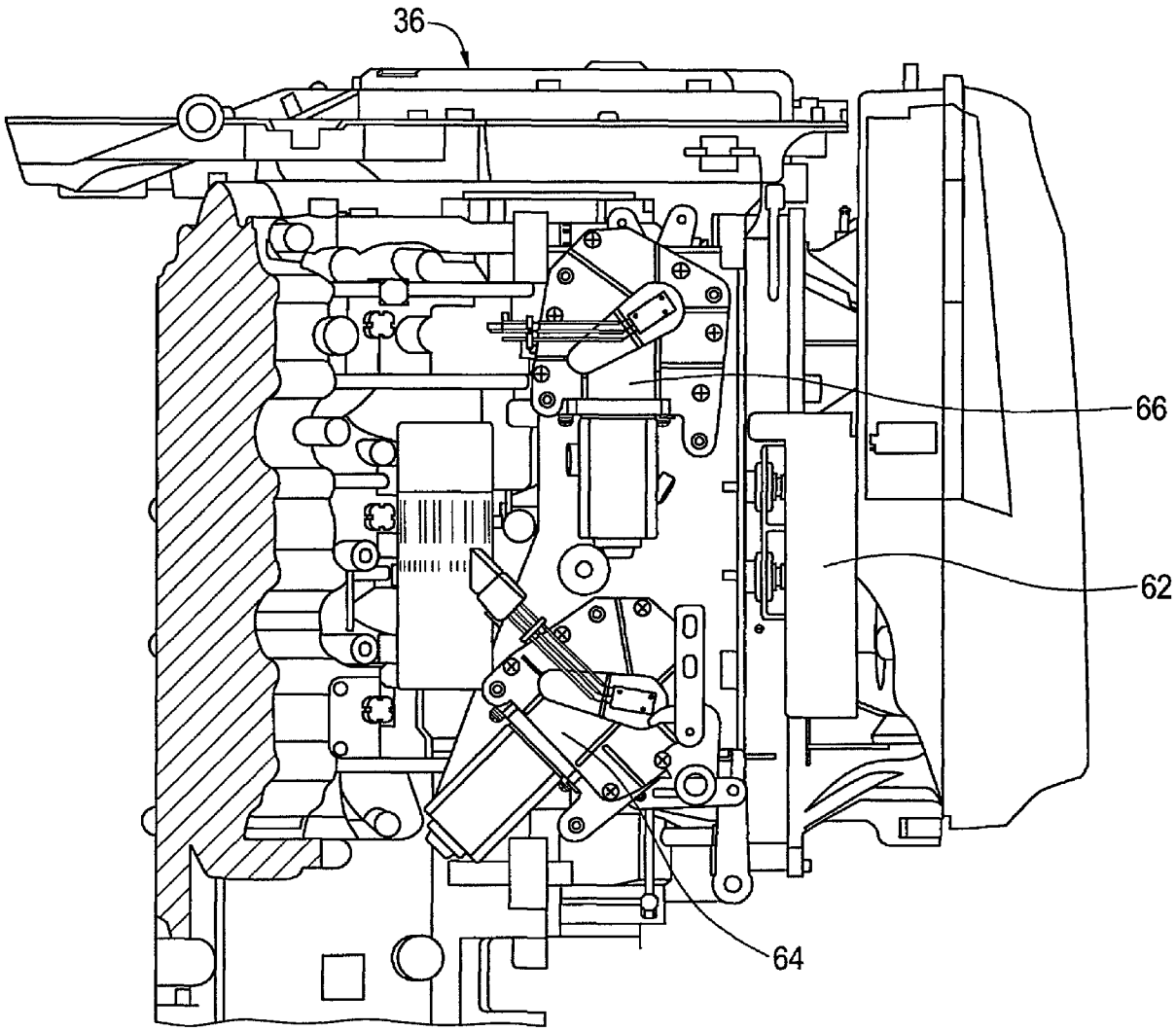
FIG. 5 is a front elevation view of an engine assembly shown in FIG. 2, shown partially in fragment and with its housing removed, showing the electronic servo module of FIG. 4, a shift actuator and a throttle actuator.

Referring now to FIG. 5, this shows engine 36 partially broken away. The electronic servo module 62 is shown as installed in a typical outboard engine, though other types of engines could be substituted. The positioning of the shift actuator 64 and the throttle actuator 66 are also shown, according to this example. With other engines other configurations may be used.

Referring to FIG. 6, the internal components of the vessel controller 102, the electronic servo module 62, and the engine management module 68 will now be described in further detail.

The vessel controller 102 has inputs and outputs, in this example, collectively in the form of transceiver 110. The transceiver 110 in this example is a CAN transceiver, namely a Philips PCA82C251. The transceiver 110 is coupled to the input/output pin 44 of the CANBus 42. The vessel controller 102 includes a host processor 104, which is preferably an embedded microcontroller. The transceiver 110 is operatively connected to the host processor 104. The transceiver 110 receives and transmits signals, which are in turn sent to the processor 104.

The host processor 104 in this example is an Infineon XC164CS type CPU, though other processors may be used. The host processor 104 hosts control software 105 that controls the vessel controller 102. The host processor 104 may be referred to as part of a command means of the vessel controller 102. According to one aspect, the host process 104 can perform the task of comparing data numbers. The host processor 104 may therefore be referred to as part of a comparing means of the vessel controller 102. According to another aspect, the host processor 104 can operatively assign a new address or instance number to be conveyed and assigned to the engine management module 68. The host processor 104 may therefore be referred to as part of an assigning means of the vessel controller 102.

The vessel controller 102 includes memory, in this example external electrically erasable programmable read-only memory (EEPROM) 106. The external EEPROM 106 in this example is in the form of a microchip 25LC160A. Memory 106 is operatively connected to the host processor 104. The vessel controller 102 provides a clock signal 101 to the external EEPROM that is electrically connected to an output pin 131 of the host processor 104. The vessel controller 102 includes a power supply 108. In this example the power supply 108 is a 12V power supply that is electrically connected to an input pin 109 of the host processor 104 in a manner configured to provide 5V to the host processor 104.

Host processors, control software, memory, and clocks per se are well known to those skilled in the art, as for example disclosed in U.S. Pat. No. 7,330,782, the disclosure of which is incorporated herein by reference. Thus their operation and various components will not be described in great detail.

Figure 7:
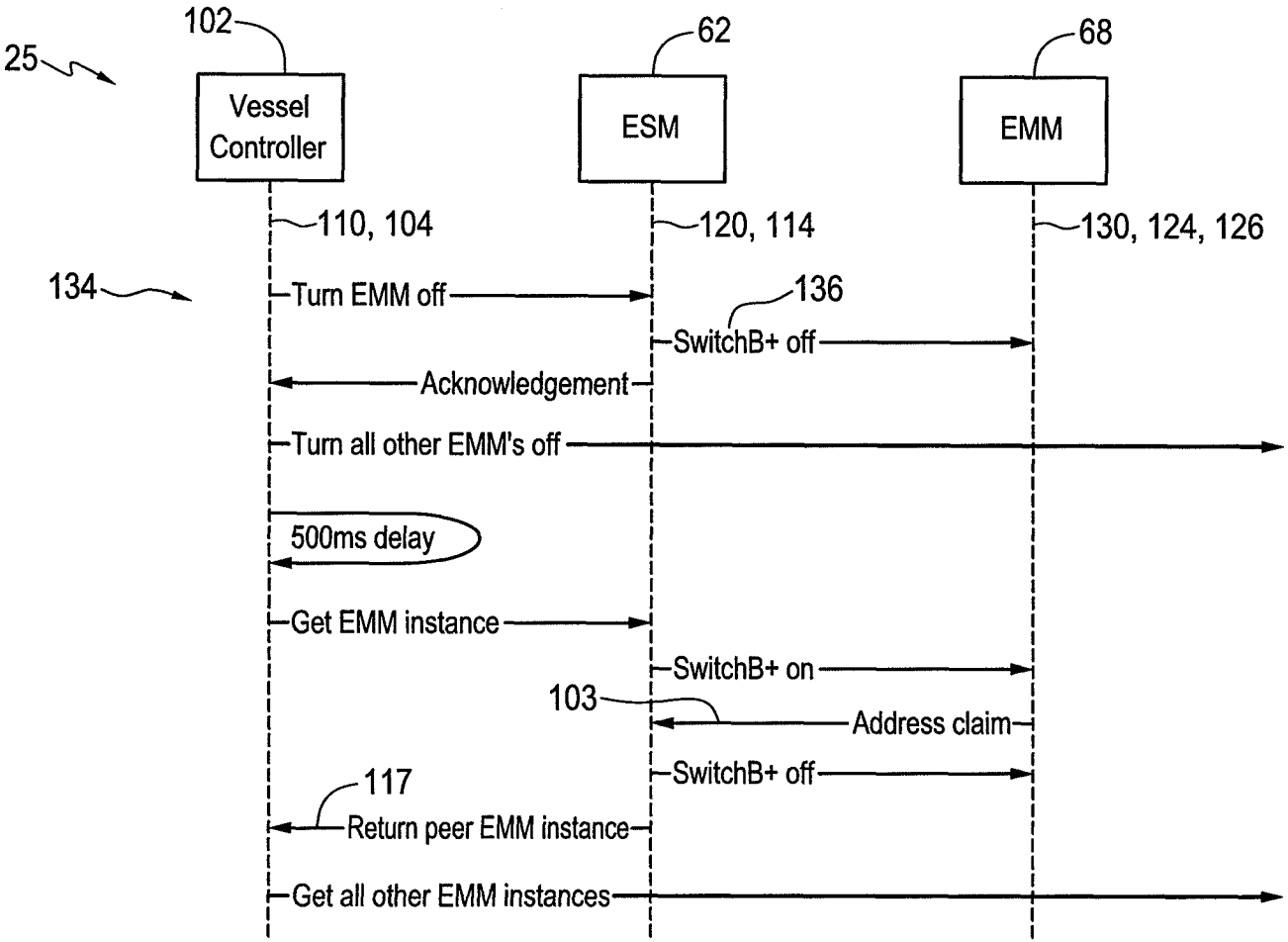
FIG. 7 is a sequence diagram of the system showing the vessel controller getting the instance numbers of the respective engine management modules.

Still referring to FIG. 6, the electronic servo module 62 has a first input, in this example, a transceiver 120 for receiving commands from the vessel controller. The transceiver 120 in this example is a CAN transceiver, namely a Philips PCA82C251. The electronic servo module 62 has a second input, in this example, also transceiver 120 for receiving an electrical signal 103, shown in FIG. 7. The electrical signal 103 represents an address, in this example, an instance number, of the electronic servo module's paired engine management module 68. The electronic servo module 62 has an output, in this example transceiver 120, for conveying a signal 117, shown in FIG. 7, representing said address.

Referring back to FIG. 6, the electronic servo module 62 includes the processor 114. The transceiver 120 is operatively connected to the processor 114. The transceiver 120 receives and transmits signals, which are in turn sent to the processor 114. The processor 114 hosts control software 115 that at least in part controls the electronic servo module 62.

The electronic servo module 62 has memory, in this example external electrically erasable programmable read-only memory (EEPROM) 116. The external EEPROM 116 in this example is in the form of a microchip 25LC160A. Memory 116 is operatively connected to the processor 114. The instance plug 112, with its instance number, in this example an instance number of 0, is shown connected to the processor 114. Memory 116 receives and stores this instance number of the electronic servo module 62. The electronic servo module 62 provides a clock signal 111 to the external EEPROM that is electrically connected to an output pin 113 of the host processor 114. The electronic servo module 62 includes a power supply 118. Preferably the power supply 118 is a 12V power supply that is electrically connected to an input pin 119 of the processor 114 in a manner configured to provide 5V to the processor 114.

Electronic servo module 62.1 is substantially the same as that described above with the exception that it may have a different instance number. In this example it has an instance number of 1, as determined by its instance plug 112. Also in this example: electronic servo module 62.2 has an instance number of 2; electronic servo module 62.3 has an instance number of 3; and electronic servo module 62.4 has an instance number of 4.

The engine management module 68, shown in FIG. 6, has an input and an output, in this example, collectively in the form of transceiver 130. The transceiver 130 in this example is a CAN transceiver, namely a Philips PCA82C251. The engine management module 68 broadcasts the electrical signal 103 shown in FIG. 7 via its transceiver 130. The electrical signal 103 contains information representing the instance number of the engine management module 68. The engine management module 68 includes a processor 124, which is preferably an embedded microcontroller. The processor 124 in this example is a Freescale HCS12 type CPU, though other processors may be used. The transceiver 130 is operatively connected to the host processor 124. The transceiver 130 receives and transmits signals, which are in turn sent to the processor 124. The processor 124 hosts control software 125 that at least in part controls the engine management module 68.

The engine management module 68 includes a power supply 128. Preferably the power supply 128 is a 12V power supply that is electrically connected to an input pin 129 of the processor 124 in a manner configured to provide 5V to the host processor 124.

The engine management module 68 has memory, in this example electrically erasable programmable read-only memory (EEPROM) 126, internal to the processor 129. Memory 126 is operatively connected to the processor 124. The memory 126 stores an address electronically identifying the engine management module 68, in this example an instance number. Engine management module 68 in this example has an initial instance number of 0. Typically engine management modules have instance numbers of 0 because in a large number of applications, a given marine vessel will only have one engine. In this example: engine management module 68.1 has an initial instance number of 0; engine management module 68.2 has an initial instance number of 0; engine management module 68.3 has an initial instance number of 0; and engine management module 68.4 has an initial instance number of 0.

The electronic servo module 62 is operatively connected to the engine management module 68 via a connecting plug, in this example conductor 122 of a printed electric circuit board, as shown in FIG. 6. The system 25 includes a switch in this example a SwitchB+ 136, shown in FIG. 8, located on the printed electrical circuit board 122, shown in FIG. 6, that links the processor 114 of the electronic servo module 62 to the power supply 128 of the engine management module 68. Referring to back FIG. 8, in the same manner: switch 136.1 links electronic servo module 62.1 to the engine management module 68.1; switch 136.2 links electronic servo module 62.2 to the engine management module 68.2; switch 136.3 links electronic servo module 62.3 to the engine management module 68.3; and switch 136.4 links electronic servo module 62.4 to the engine management module 68.4.

Referring to FIG. 6, typically the electronic servo modules have instance numbers different from each other, for example instance numbers 0 to 4. These different instance numbers are each known to the vessel controller 102 for the purposes of distinguishing between the electronic servo modules. However the engine management module instance numbers are often pre-set to each initially have an instance number of 0. In such situations the vessel controller 102 is not able to distinguish between the engine management modules. The particular instance numbering scheme described is for illustration purpose only. Any other numbering or lettering or even naming scheme, such as defined by NMEA2K, can also be employed with this instancing method.

The system 25 as herein disclosed has the ability to automatically set, or reset, all engine management module instance numbers.

Because the system 25 has the ability to perform auto-instancing, that is automatically set all engine management module instance numbers, the system 25 can advantageously ensure that each electronic servo module-engine management module 68 pair is associated with the same instance number. For example, since electronic servo module 62 has an instance number of 0, the system 25 can ensure that engine management module 68 also has an instance number of 0. Since electronic servo module 62.1 has an instance number of 1, the system 25 can change the instance number of engine management module 68.1 to ensure that engine management module 68.1 also has an instance number of 1, and likewise ensure the remaining pairs of electronic servo modules and engine management modules have the same instance numbers.

The operation of the system 25 as it relates to auto-instancing, and as generally outlined above, will now be discussed greater detail.

Referring to FIG. 6, during the start up of the control system 25 (and control head 28), the control head 28 via the vessel controller 102 will automatically proceed to an auto-instancing state to check the instance numbers of the engine management modules 68. This occurs if any user input, for example via push button, switch, or lever movement, is detected or if no other control heads are present on the network. Auto-instancing is initiated and coordinated by the control head 28 via the vessel controller 102, but does not start in this example until it the control head 28 is selected by the user or it auto-selects itself. The auto-instancing state will now be described.

The first step in this process is detecting whether any instance numbers need to be changed. This process 134 is shown generally in FIG. 7.

The vessel controller 102 tells each electronic servo module in the system 25 to go into its auto-instancing state. The electronic servo modules enter their auto-instancing states when they receive an "auto-instance init" command from the vessel controller 102. In the auto-instancing state, each electronic servo module stops transmitting its heart beat message on the private CANBus network 42. This inhibits any heart-beat faults from occurring while proceeding. Each electronic servo module ignores shift, throttle, trim, start and stop commands from the control head 28. Each electronic servo module accepts auto-instancing commands from the vessel controller 102.

Next, and referring to FIG. 7, the vessel controller 102 via its processor 104 and transceiver 110, commands electronic servo module 62 to turn its peer engine management module 68 off. Electronic servo module 62 receives this command signal via its transceiver 120. The processor 114 of the electronic servo module 62 receives this command and proceeds to turn the Switch B+ 136 output off. Once this has been done, electronic servo module 62 sends an acknowledgement back to the vessel controller 102 via its respective transceiver 120. The vessel controller 102 repeats this process for each other electronic servo module 62.1, 62.2, 62.3 and 62.4 and engine management module 68.1, 68.2, 68.3, and 68.4. The vessel controller 102 next waits for a period of time, in this example, 500 milliseconds, to ensure that all engine management modules are completely switched off. All of the engine management modules 68-68.4 are shown switched off in FIG. 8.

Figure 9:
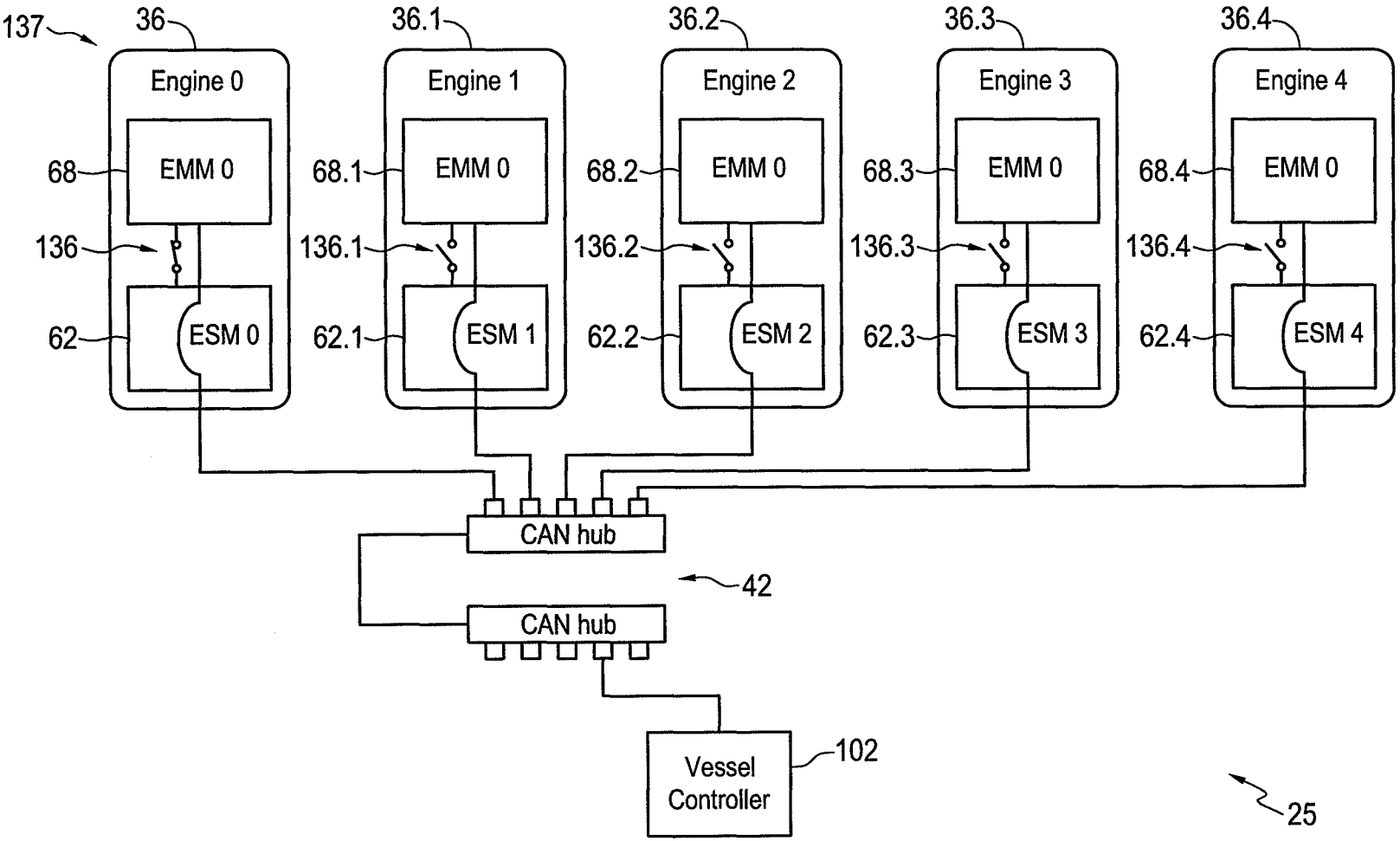
FIG. 9 is a block diagram of the system similar to FIG. 8 showing a first engine management module switched on and all other engine management modules switched off.

The vessel controller 102 next tells each electronic servo module 62-62.4 in the system 25 to in turn get its peer engine management module instance number. To do so and referring to FIG. 7, the vessel controller 102 commands the electronic servo module 62, having an instance number in this example of 0, to switch on switch B+ 136 and thereby switch on engine management module 68. This is shown in FIG. 9. The electronic servo module 62 then reads the instance number broadcast in the engine management module 68 address claim message or electrical signal 103 illustrated in FIG. 7. In this example the instance number of engine management module 68 is 0. When finished, the electronic servo module 62 switches off switch B+ 136 and thereby switches off the engine management module 68. The electronic servo module 62 next conveys via its transceiver 120 signal 117 representing the instance number 0 of the engine management module 68 to the vessel controller 102. The vessel controller 102 stores this information in its memory and thus now has information that the electronic servo module 62, having an instance number of 0, is associated with an engine management module having an instance number of 0.

Figure 10:
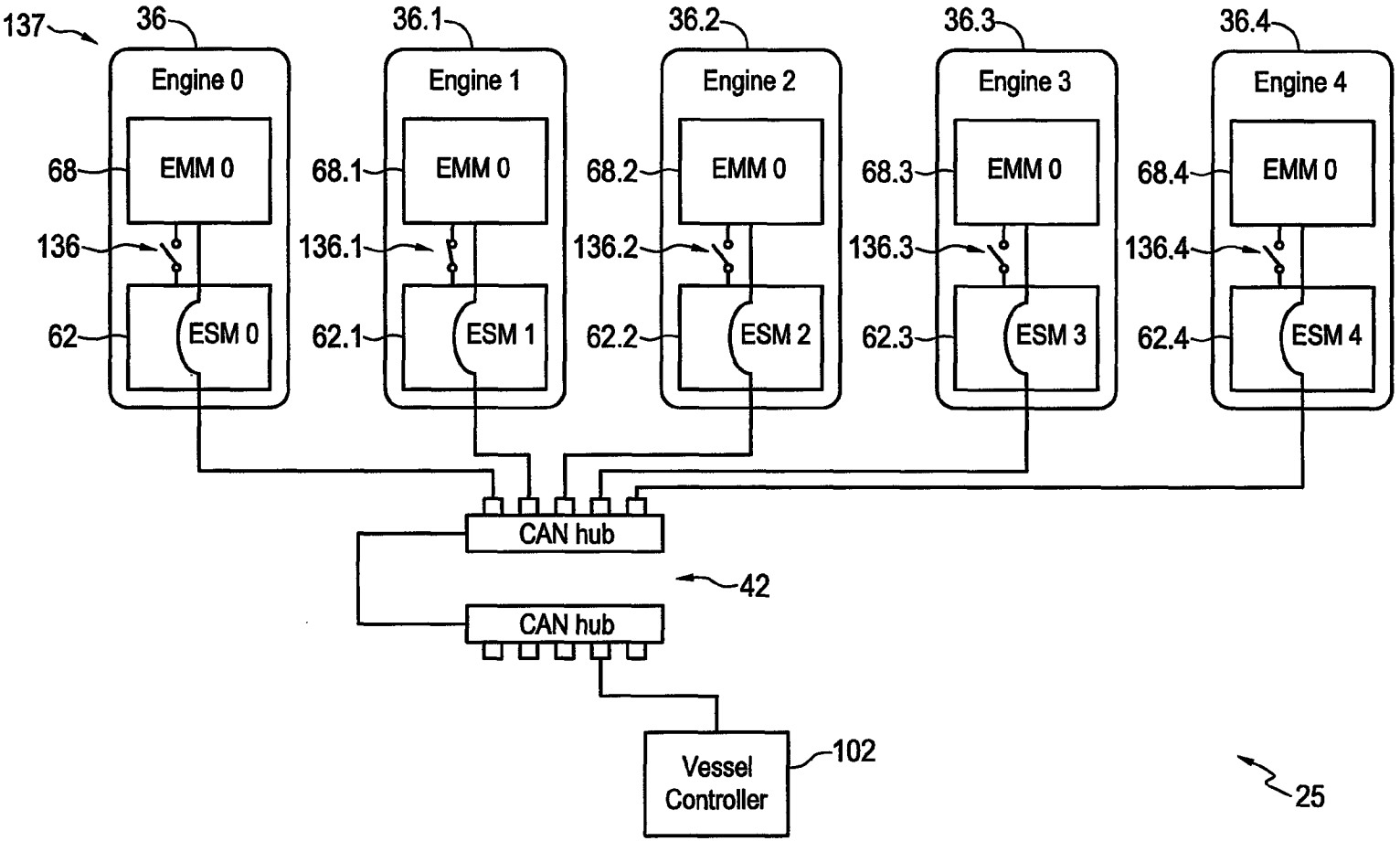
FIG. 10 is a block diagram of the system similar to FIG. 8 showing a second engine management module switched on and all other engine management modules switched off.
Figure 11:
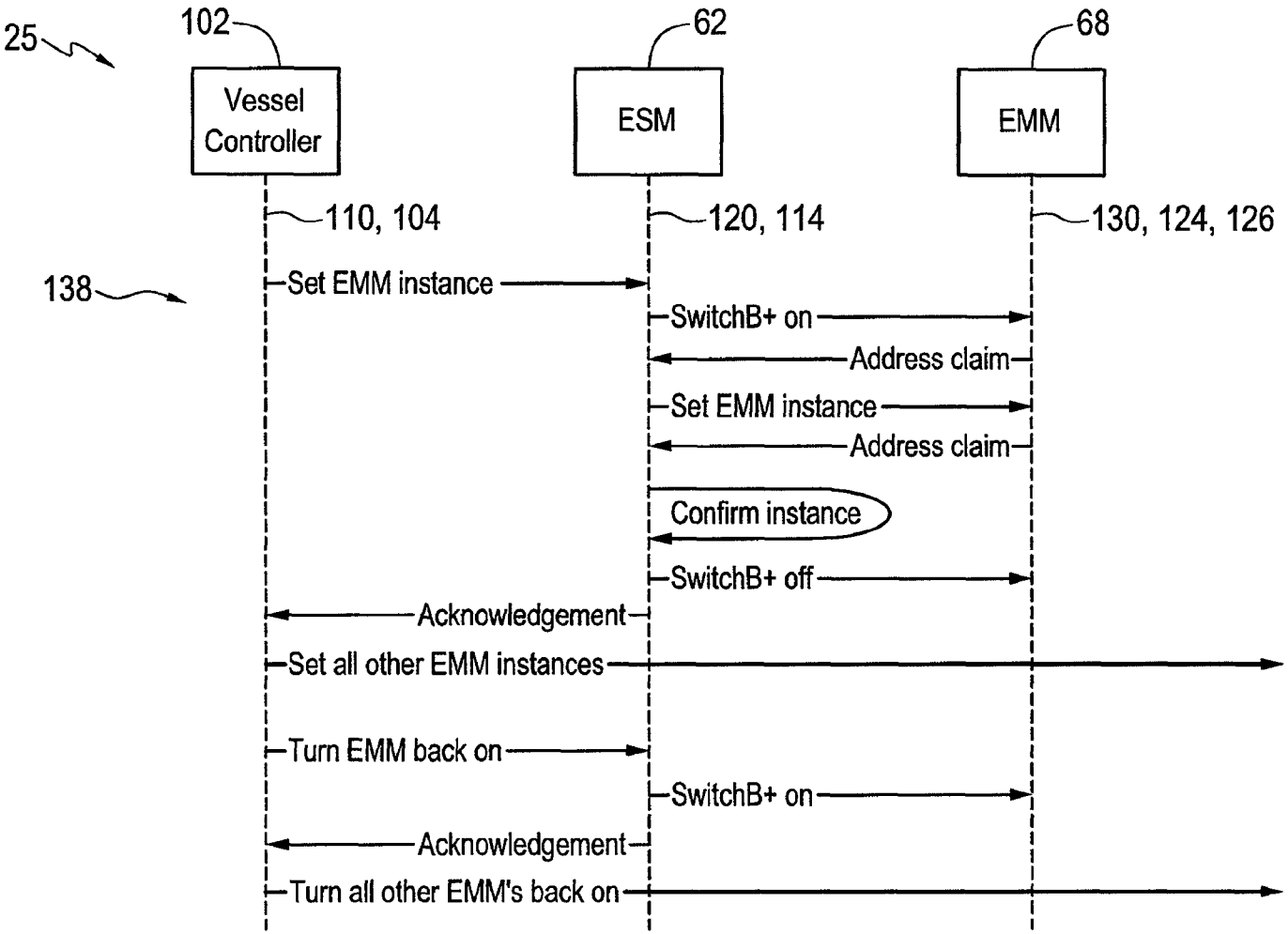
FIG. 11 is a sequence diagram of the system shown in FIG. 2 with the vessel controller assigning instance numbers to the engine management modules.

The vessel controller 102 next commands the electronic servo module 62.1, which has an instance number in this example of 1, to switch on its switch B+ 136.1 and thereby switch on the engine management module 68.1, as shown in FIG. 10. The electronic servo module 62.1 reads the initial instance number broadcast in the engine management module 68.1 address claim message. In this example the initial instance number of engine management module 68.1 is 0. When finished, the electronic servo module 62.1 switches off switch B+ 136.1 and thereby switches off the engine management module 68.1. The electronic servo module 62.1 conveys via its transceiver a signal representing the instance number 0 of the engine management module 68.1 to the vessel controller 102. The vessel controller 102 stores this information in its memory and thus now has information that the electronic servo module 62.1, having an instance number of 1, is associated with an engine management module having an instance number of 0.

This process is repeated for the rest of the engines 36.2, 36.3 and 36.4. The vessel controller 102 thus now has information that: electronic servo module 36.2, which in this example has an instance number of 2, is associated with an engine management module 68.2 having an initial instance number of 0; electronic servo module 36.3, which in this example has an instance number of 3, is associated with an engine management module 68.3 having an initial instance number of 0; and electronic servo module 36.4, which in this example has an instance number of 4, is associated with an engine management module 68.4 having an initial instance number of 0.

The vessel controller 102 is not able to distinguish between engine management modules in this case of engine management modules with duplicate instance numbers when all the switches 136 are switched on. This is because, as shown in FIG. 6, the electronic servo modules and the engine management modules are all directly coupled to the vessel controller 102 via the CANBus network 42. The vessel controller 102 now has information that there is more than one engine management module having an instance number of 0 but cannot distinguish between them.

Because the vessel controller 102 has detected a situation where there are at least two engine management modules with duplicate instance numbers, the system 25 in its auto-instancing state next proceeds via its controller 102 to assigning at least one new instance number to at least one engine management module. This process 138 is shown generally in FIG. 11.

Figure 8:
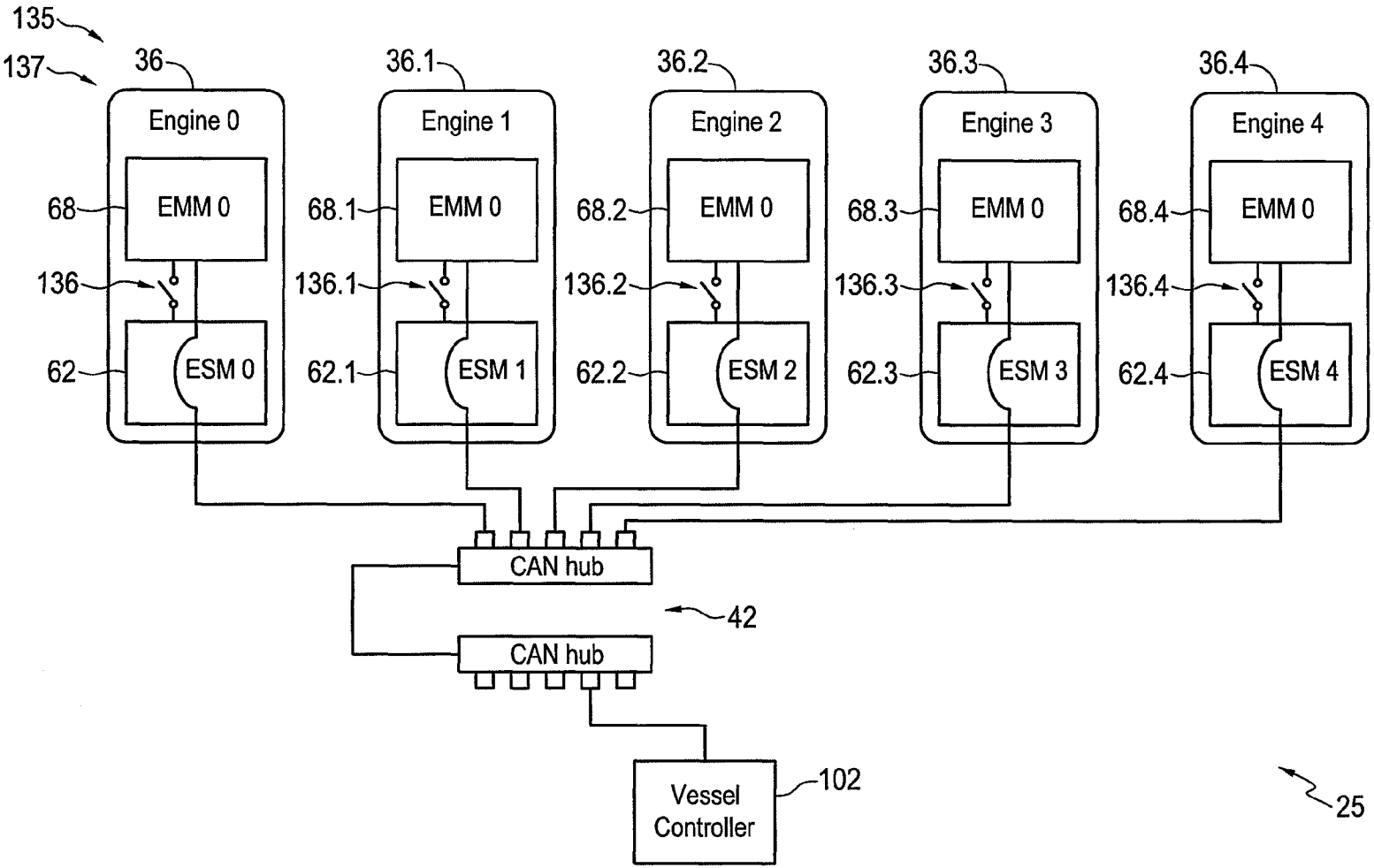
FIG. 8 is a block diagram of the system shown in FIG. 2 with the engine management modules switched off.
Figure 12:
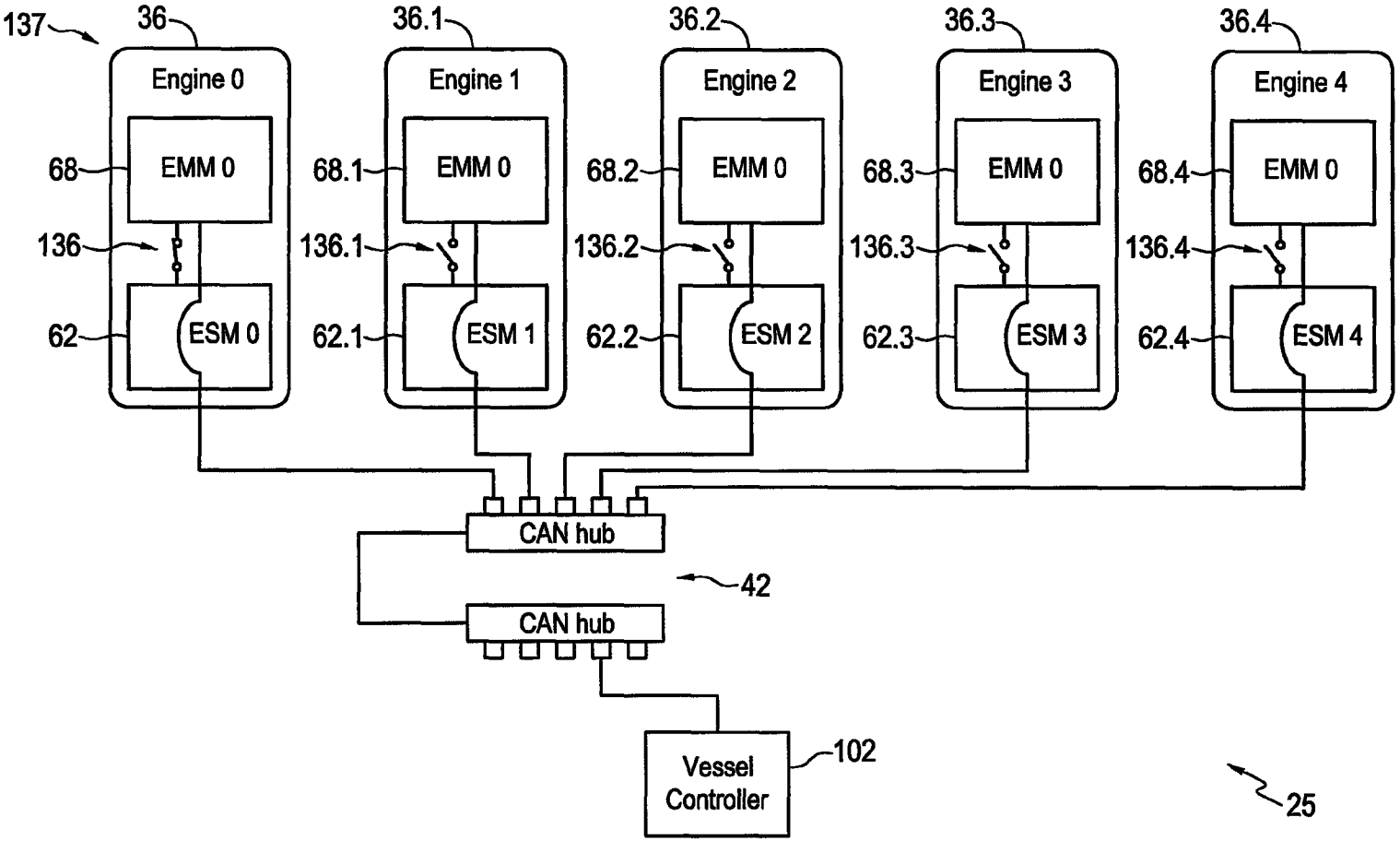
FIG. 12 is a block diagram of the system identical to FIG. 9 showing the first engine management module switched on and assigned an instance number of 0 by the vessel controller, and all other engine management modules switched off.

The vessel controller 102 tells each electronic servo module to set its peer engine management module. Each engine management module is initially turned off, as shown in FIG. 8. The vessel controller 102, via its processor 104 and transceiver 110, commands electronic servo module 62 to turn its peer engine management module 68 on, as shown in FIG. 12. The processor 114 of the electronic servo module 62 receives this command via the transceiver 120 of the electronic servo module 62. Electronic servo module 62 uses the command group function in this example parameter ground number, as defined in the NMEA2K standard, to set the engine management module 68 instance number. If the new instance number is accepted by engine management module 68, the engine management module 68 immediately broadcasts an address claim message containing the new instance number. This is used by the electronic servo module 62 to validate that the instance number of the engine management module 68 was properly changed. When finished, the electronic servo module 62 turns its peer engine management module 68 off. In this example the engine management module 68 instance number was 0 and the electronic servo module 62, having an instance number of 0, keeps the engine management module 68 instance number at 0. Lastly an acknowledgement signal that the task has been completed is sent by the electronic servo module 62 to the vessel controller 102.

Figure 13:
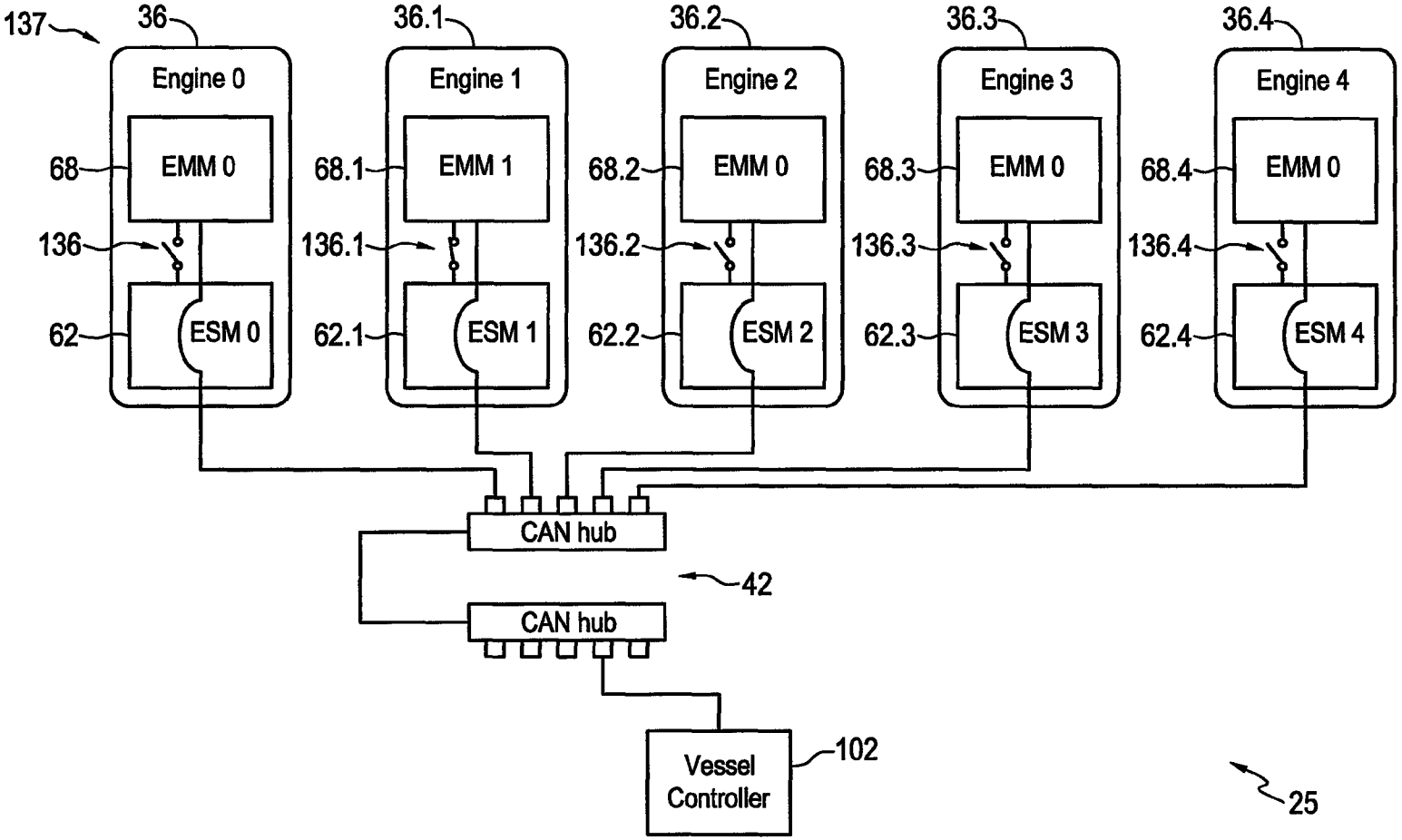
FIG. 13 is a block diagram of the system similar to FIG. 10 showing the second engine management module switched on and assigned an instance number of 1 by the vessel controller, and all other engine management modules switched off.

Next, the vessel controller 102 commands electronic servo module 62.1 to turn on its peer engine management module 68.1 as shown in FIG. 13. Electronic servo module 62.1 uses the command group function in this example parameter ground number, as defined in the NMEA2K standard, to set the engine management module 68.1 instance number. In this example, the electronic servo module 62.1 has an instance number of 1 and sets the engine management module 68.1 to have an instance number of 1, as shown in FIG. 13. If the new instance number is accepted by engine management module 68.1, the engine management module 68.1 immediately broadcasts an address claim message containing the new instance number. This is used by the electronic servo module 62.1 to validate that the instance number was properly changed. When finished, the electronic servo module 62.1 turns off its peer engine management module 68.1 and sends an acknowledgement signal to the vessel controller 102.

Figure 14:
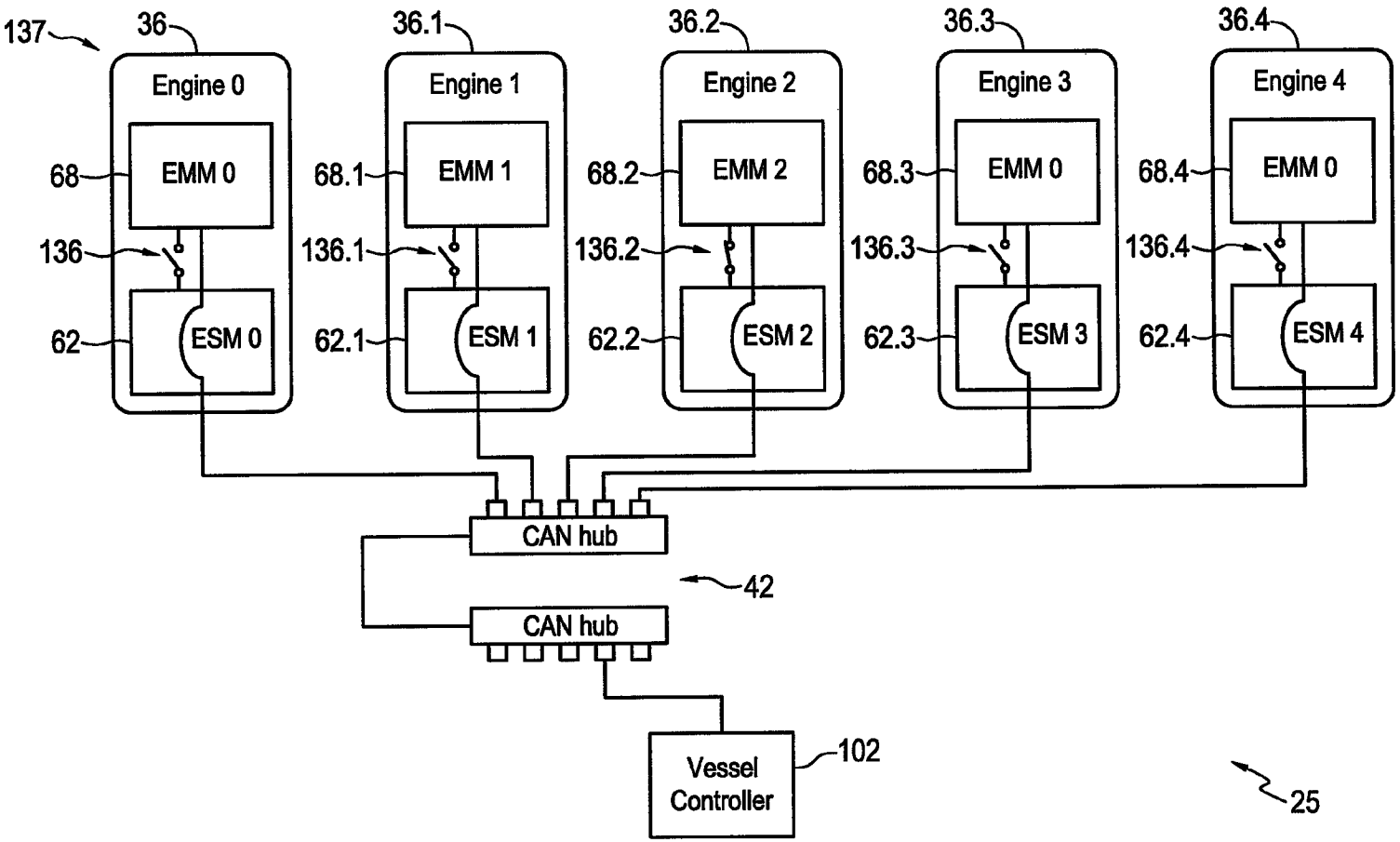
FIG. 14 is a block diagram of the system similar to FIG. 13 showing a third engine management module switched on and assigned an instance number of 2 by the vessel controller, and all other engine management modules switched off.

The vessel controller 102 next commands electronic servo module 62.2 to turn on its peer engine management module 68.2, as shown in FIG. 14. Electronic servo module 62.2 uses the command group function in this example parameter ground number, as defined in the NMEA2K standard, to set the engine management module 68.2 instance number. In this example, the electronic servo module 62.2 has an instance number of 2 and sets the engine management module 68.2 to have an instance number of 2, as shown in FIG. 14. If the new instance number is accepted by engine management module 68.2, the engine management module 68.2 immediately broadcasts an address claim message containing the new instance number. This is used by the electronic servo module 62.2 to validate that the instance number was properly changed. When finished, the electronic servo module 62.2 turns off its peer engine management module 68.2 and sends an acknowledgement signal to the vessel controller 102.

Figure 15:
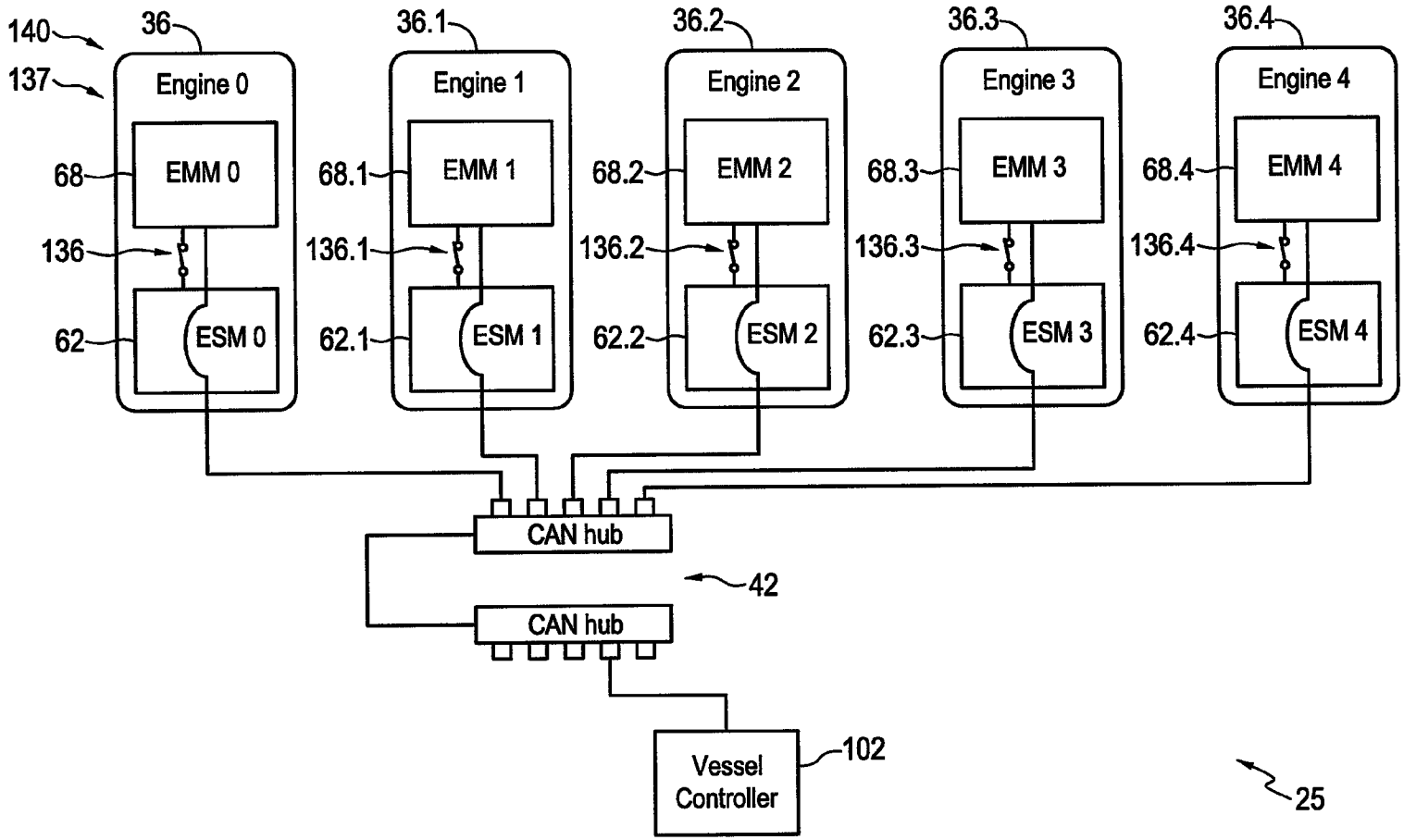
FIG. 15 is a block diagram of the system similar to FIG. 14 showing all the engine management modules switched on and assigned unique instance numbers by the vessel controller.

This process is repeated for the rest of the engines 36.3 and 36.4, with the net result being in this example shown in FIG. 15: electronic servo module 36.3, having the instance number 3, is associated with an engine management module 68.3 now having an instance number of 3; and electronic servo module 36.4, having the instance number 4, is associated with an engine management module 68.4 now having an instance number of 4.

After all the engine management module instance numbers have been set, the vessel controller 102 commands all electronic servo modules 62-62.4 to turn their peer engine management modules 68-68.4 back on again, as shown in FIG. 15. When the electronic servo modules receive a vessel controller command to terminate the auto-instancing process, the electronic servo modules go back to their normal state of operation. With the auto-instancing process thus being finished, the control head 28 may go to an active state of operation and the electronic servo modules may go to their normal states of operation.

The system 25 will automatically start auto-instancing when an electronic servo module is powered-up into a functional system, including the first time it is so powered-up. Referring to FIG. 6, after power is applied to the system 25 and internal processor (CPU) peripheral initialization is completed, each electronic servo module 62-62.4 enters the startup state. In this state, each electronic servo module 62 ignores shift, throttle, trim, start and stop commands from the control head 28. Each electronic servo module latches its internal power supply 118 on. Each electronic servo module turns on its corresponding SwitchB+ 136, shown in FIG. 7, output. This thereby turns on each electronic servo module's paired engine management module. Each electronic servo module next starts the transmission of its heartbeat message on the private CANBus network 42. Each electronic servo module reads the instance plug 112 value. The processor 114 converts the analog to digital converter reading to an instance number of either 0, 1, 2, 3 or 4.

If the instance plug 112 and associated instance number of the electronic servo module 62 match the configured peer engine management module instance value stored in the non-volatile memory 116, the electronic servo module goes to a normal state of operation.

If the instance plug 112 does not match the configured peer engine management module instance value, the electronic servo module goes to an auto-instancing state. The vessel controller 102 and the electronic servo modules enter the auto-instancing state when at least one of the electronic servo modules has an instance plug 112 that does match its configured peer engine management module instance value stored in the non-volatile memory 116. In the auto-instancing state, the electronic servo modules: stop transmitting their heart beat messages on the private CANBus network 42; ignore shift, throttle, trim, start and stop commands from the control head 28; and accept auto-instancing commands from the control head 28 via the vessel controller 102. The auto-instancing process then proceeds as described previously above. When the electronic servo modules receive a command from the control head 28 to terminate the auto-instancing process, they go to their normal state.

The system 25 is also configured to initiate the auto-instancing state and process based on other factors. The system 25 will automatically start auto-instancing when duplicate or out-of-range engine management module instance numbers are detected. The system 25 will also automatically start auto-instancing when an instance plug 112 connected to an electronic servo module has changed.

The system 25 will automatically start auto-instancing when duplicate or out-of-range electronic servo module instance numbers are detected. When electronic servo modules with duplicate instance numbers are detected, the control head 28 via the vessel controller 102 enables one of the duplicate electronic servo modules and disables all the other ones for the current power-up cycle. The vessel controller 102 preferably enables an electronic servo module that has a peer engine management module with an instance number that matches that of the electronic servo module. For example, if there are two electronic servo modules with instance numbers of 0 and their peer engine management modules have instance numbers of 0 and 1, respectively, the electronic servo module with the engine management module having an instant number of 0 will be enabled. If such a situation does not arise, the duplicate electronic servo module that is enabled is selected randomly by the vessel controller 102. According to one example, duplicate electronic servo modules are indicated on the control head 28 by flashing rapidly of a neutral lamp associated with the duplicate engines.

In short, the system 25 automatically detects if there are duplicate electronic servo modules, and if so, the system 25 via the vessel controller 102 disables one of them. The duplicate, disabled electronic servo module is readily reconfigurable by changing the instance plug 112 to an instance plug having a non-duplicate instance number. For example, if the system 25 is a three engine system, with electronic servo module instance numbers of 0, 1 and 2 for each of the three engines, respectively, and the vessel controller 102 detects a fourth engine, with an electronic servo module having an instance number of 0, 1 or 2, the vessel controller 102 disables the fourth engine. The fourth engine can be added to the system by, for example, replacing the instance plug 112 of the fourth engine with an instance plug having an instance number of 3.

Every time the system 25 is powered-up with duplicate electronic servo module 62 instance numbers, the control head 28 stays dark and inactive until auto-instancing completes.

While the control head 28 via the vessel controller 102 is coordinating the auto-instancing sequence, it does not respond to any user inputs. Once the configuration sequence is complete, the control head 28 becomes active. In a preferred embodiment, the following table outlines the amount of time the system 25 needs to perform auto-instancing. During that time, all control head 28 indicators remain dark.

TABLE 1

Auto-instancing duration

| System type | Auto-instancing duration |
|---|---|
| Single engine | 3 sec |
| Dual engines | 6 sec |
| Triple engines | 9 sec |
| Quadruple engines | 12 sec |
| Quintuple engines | 15 sec |

Accordingly to preferred embodiments, for a marine vessel having a single engine 36, auto-instancing will only take a maximum of three seconds. For a marine vessel having two engines, auto-instancing will only take a maximum of six seconds. For a marine vessel having three engines, auto-instancing will only take a maximum of nine seconds. For a marine vessel having four engines, auto-instancing will only take a maximum of twelve seconds. For a marine vessel having five engines, auto-instancing will only take a maximum of fifteen seconds. Accordingly to preferred embodiments, for a marine vessel having no duplicate or out-of-range ESMs 62 and no duplicate or out-of-range EMMs 68, auto-instancing terminates right after all of the addresses of the ESMs 62 and all of the addresses of the EMMs 68 have been received and validated by the vessel controller 102 and will take a maximum of 500 ms.

According to one example, engine management module instance numbers are defined as per the NMEA2K definition, which is a standard for serial data neworking of marine electronic devices on CAN. Preferred engine management module instance numbers for the system 25 are summarized in the table below:

TABLE 2

Instance number scheme

| | Engine Management Module Instance numbers | | | | |
|---|---|---|---|---|---|
| Number of engines | Port | Port center | Center | Starboard center | Starbord |
| 1 | 0 | | | | |
| 2 | 0 | | | | 1 |
| 3 | 0 | | 1 | | 2 |
| 4 | 0 | 1 | | 2 | 3 |
| 5 | 0 | 1 | 2 | 3 | 4 |

For a system 25 where the marine vessel has one engine, the engine management module 68 will keep its default instance number of 0. For a marine vessel with two engines 36, the system 25 ensures that the engine management module 68 adjacent to the port side 21 has an instance number of 0 and the engine management module 68.1 adjacent to the starboard side 23 is assigned an instance number of 1.

For a marine vessel with three engines, the system 25 according to a preferred embodiment ensures that the engine management module 68 adjacent to the port side 21 has an instance number of 0, the engine management module 68.1 located in the center is assigned an instance number of 1 and the engine management module 68.2 adjacent to the starboard side 23 is assigned an instance number of 2.

For a marine vessel with four engines, the system 25 according to a preferred embodiment ensures that the engine management module 68 adjacent to the port side 21 has an instance number of 0, the engine management module 68.1 located in the port-center position has an instance number of 1, the engine management module 68.2 located in the starboard-center position has an instance number of 2, and the engine management module 68.3 adjacent to the starboard side 23 is assigned an instance number of 3.

For a marine vessel with five engines, the system 25 according to a preferred embodiment ensures that the engine management module 68 adjacent to the port side 21 has an instance number of 0, the engine management module 68.1 located in the port-center position has an instance number of 1, the engine management module 68.2 located in the center position has an instance number of 2, the engine management module 68.3 located in the starboard-center position has an instance number of 3, and the engine management module 68.4 adjacent to the starboard side 23 is assigned an instance number of 4.

The above listed instance numbers and configurations are described as preferred examples, though those skilled in the art will appreciate that other variations of instance number configurations are feasible.

The system 25 as herein described provides the advantage of not requiring an external tool to set up multi engine systems.

The auto-instancing of the system 25 could be initiated by the user on a sequence of key inputs at the control head 28. The auto-instancing of the system 25 could be requested by the engine management modules.

It will be understood by someone skilled in the art that many of the details provided above are by way of example only and are not intended to limit the scope of the invention which is to be determined with reference to the following claims.

What is claimed:

1. A system for automatically instancing marine engines of a marine vessel, the system comprising:

a plurality of servo controllers;

a plurality of engine control units;

the plurality of engine control units, each having an address and being electronically paired with a respective one of the servo controllers; and a vessel controller in communication with the servo controllers;

the servo controllers, the engine control units and the vessel controller connected to and communicating with one another via a network, the vessel controller commanding the servo controllers to switch off the engine control units, the vessel controller then commanding in turn each of the servo controllers to switch on its paired one of the engine control units, read the address of its paired one of the engine control units, switch off its paired one of the engine control units, and convey the address back to the vessel controller, and the vessel controller then comparing the addresses of the engine control units;

whereby if at least two of the addresses of the engine control units are duplicates of each other, the vessel controller ascertains that at least one of the addresses of the engine control units needs to be changed.

2. The system as claimed in claim 1, wherein each of the addresses is an instance number.

3. The system as claimed in claim 1, wherein if at least two engine control units have duplicate addresses, the vessel controller assigns a new address to one of the at least two engine control units having duplicate addresses.

4. The system as claimed in claim 1, wherein the vessel controller has command means for commanding each of the servo controllers to switch off the engine control units and for commanding in turn each of the servo controllers to switch on its paired one of the engine control units, read the address of its paired one of the engine control units, switch off its paired one of the engine control units, and convey the address back to the vessel controller and the vessel controller has comparing means for comparing the addresses of the engine control units.

5. The system as claimed in claim 4, wherein the vessel controller further has assigning means for assigning a new address to an engine controller unit, and if at least two engine control units have duplicate addresses, the assigning means assigns the new address to one of the engine control units having duplicate addresses.

6. The system as claimed in claim 1, wherein each of the engine control units broadcasts an electrical signal representing its address, and each of the servo controllers has a transceiver for receiving commands from the vessel controller, for receiving the electrical signal representing the address of its paired one of the engine control units and for conveying a signal representing the address of its paired one of the engine control units to the vessel controller.

7. The system as claimed in claim 6, further including a plurality of switches, a switch respectively interposed between each of the servo controllers and its paired engine control unit, the servo controllers capable of switching on or off the engine control units via actuation of the switches.

8. The system as claimed in claim 7, wherein the vessel controller is capable of identifying the address of each of the engine control units by commanding in turn each of the servo controllers to activate its respective switch and switch on its paired one of the engine control units thereby, to receive via its transceiver the electrical signal representing the address of its paired one of the engine control units and to convey via its transceiver the signal representing the address of its paired one of the engine control units to the vessel controller.

9. The system as claimed in claim 3, further including a plurality of engines paired with respective ones of the engine control units, and wherein the system is an electronic shift and throttle system and the vessel controller is a control head of the marine vessel.

10. The system as claimed in claim 3, further including a CAN hub, the servo controllers, the engine control units and the vessel controller connecting to the CAN hub, the vessel controller being electrically coupled to the servo controllers via the CAN hub.

11. The system as claimed in claim 10, wherein the servo controllers each further include a connecting plug for plugging into its paired one of the engine control units, the engine control units being electronically paired with respective ones of the servo controllers.

12. The system as claimed in claim 3, wherein the vessel controller includes a host processor, the vessel controller hosting control software for the host processor, the control software controlling the vessel controller, and the vessel controller having memory for storing the at least one new address.

13. The system as claimed in claim 1, wherein the servo controllers have addresses unique relative to each other and the vessel controller ascertains the identity and arrangement of each of the servo controllers via the addresses of the servo controllers.

14. The system as claimed in claim 1, further including a plurality of interchangeable data holders, the data holders being paired with respective servo controllers, each of the data holders containing an address for electronically identifying the servo controller to which it is connected, the vessel controller ascertaining the identity and arrangement of each of the servo controllers via the data holders.

15. The system as claimed in claim 14, wherein each of the servo controllers has a socket, the data holders are instance plugs, and the addresses of the instance plugs are instance numbers, and wherein the instance plugs are selectively connectable via the sockets to respective servo controllers.

16. A system for operatively assigning identities to a plurality of engines of a marine vessel, the system comprising:

a plurality of servo controllers;

a plurality of engine control units each associated with a respective one of the engines and being electronically paired with a respective one of the servo controllers; and a vessel controller in communication with the servo controllers;

the servo controllers, the engine control units and the vessel controller connected to and communicating with one another via a network, the vessel controller commanding the servo controllers to switch off the engine control units, commanding in turn each of the servo controllers to switch on its paired one of the engine control units, assign a set address to its paired one of the engine control units and switch off its paired one of the engine control units, each of the set addresses corresponding to a unique identity, whereby the engines are associated with the set addresses identifiable to the vessel controller.

17. The system as claimed in claim 16, wherein the vessel controller includes a host processor, the vessel controller hosting control software for the host processor, the control software controlling the vessel controller, and the vessel controller having memory for storing the set addresses associated with each of the engines, respectively.

18. The system as claimed in claim 16, wherein the system includes up to five servo controllers and five engine control units, and the system requires 500 milliseconds or less in order to detect whether one or more of the addresses of the engine control units needs to be changed.

19. A method of automatically detecting whether at least one instance number associated with at least one of a plurality of engine control units of a marine vessel needs to be changed, the marine vessel having a vessel controller, the engine control units each having an instance number, the method comprising:

the vessel controller causing the engine control units to switch off;

the vessel controller causing one of the engine control units to switch on, causing the instance number of the one of the engine control units to be read, causing the one of the engine control units to switch off and causing the instance number so read to be conveyed to the vessel controller;

the vessel controller causing an other of the engine control units to switch on, causing the instance number of the other of the engine control units to be read, causing the other of the engine control units to switch off and causing the instance number of the other of the engine control units to be conveyed to the vessel controller;

the vessel controller comparing the instance numbers of the engine control units, whereby if at least two of the instance numbers of the engine control units are duplicates of each other, the vessel controller ascertains that at least one of the instance numbers of the engine control units needs to be changed.

20. The method as claimed in claim 19, wherein if at least two of the instance numbers are duplicates of each other, the vessel controller causing one of the engine control units having a duplicate instance number to be assigned at least one new instance number.

21. The method as claimed in claim 19, wherein each of the engine control units being paired with servo controllers; wherein the vessel controller being electronically coupled to the servo controllers in a manner predetermined by the vessel controller; the method further comprising, within the vessel controller causing steps:

the vessel controller commanding the servo controllers to switch off the engine control units;

the vessel controller commanding in turn each of the servo controllers to switch on its paired one of the engine control units, read the instance number of its paired one of the engine control units, switch off its paired one of the engine control units, and convey the instance number back to the vessel controller.

22. The method as claimed in claim 21, wherein if at least two of the instance numbers are duplicates of each other, the vessel controller commanding a servo controller associated with one of the engine control units having a duplicate instance number to assign at least one new instance number to its peered engine control unit.

23. The method as claimed in claim 22, the method including automatically detecting and assigning of a new instance number in six seconds or less for a system comprising two servo controllers and two engine control units.

24. The method as claimed in claim 22, the method including automatically detecting and assigning of a new instance number in nine seconds or less for a system comprising three servo controllers and three engine control units.

* * * * *